US008919921B2

(12) United States Patent
Takeuchi

(10) Patent No.: US 8,919,921 B2
(45) Date of Patent: Dec. 30, 2014

(54) IMAGE FORMING APPARATUS

(71) Applicant: Shotaro Takeuchi, Kanagawa (JP)

(72) Inventor: Shotaro Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/075,128

(22) Filed: Nov. 8, 2013

(65) Prior Publication Data

US 2014/0132668 A1 May 15, 2014

(30) Foreign Application Priority Data

Nov. 15, 2012 (JP) ..... 2012-251593
Feb. 6, 2013 (JP) ..... 2013-021840

(51) Int. Cl.
*B41J 2/165* (2006.01)
*B41J 29/393* (2006.01)

(52) U.S. Cl.
CPC ..... *B41J 2/16579* (2013.01)
USPC ..... 347/33; 347/19

(58) Field of Classification Search
USPC ..... 347/19, 20, 22, 32, 33
See application file for complete search history.

(56) References Cited

U.S. PATENT DOCUMENTS

| | | | | |
|---|---|---|---|---|
| 7,334,859 | B2 * | 2/2008 | Kojima | 347/19 |
| 7,854,489 | B2 * | 12/2010 | Hagiwara et al. | 347/19 |
| 8,087,294 | B2 * | 1/2012 | Yoshie | 73/432.1 |
| 8,147,028 | B2 * | 4/2012 | Ito | 347/23 |
| 2009/0256892 | A1 | 10/2009 | Takeuchi | |
| 2010/0171799 | A1 | 7/2010 | Takeuchi et al. | |
| 2011/0057997 | A1 | 3/2011 | Takeuchi | |

FOREIGN PATENT DOCUMENTS

| | | |
|---|---|---|
| JP | 2004-306475 | 11/2004 |
| JP | 2007-050533 | 3/2007 |
| JP | 2008-023886 | 2/2008 |
| JP | 2013-121667 | 6/2013 |

* cited by examiner

*Primary Examiner* — Ahn T. N. Vo
(74) *Attorney, Agent, or Firm* — Cooper & Dunham LLP

(57) ABSTRACT

An image forming apparatus includes a recording head, an ejection detector, and a cleaner. The ejection detector detects ejection or non-ejection of droplets from the head and has an electrode member disposed in an area in which the electrode member is opposable to the head. The cleaner cleans the electrode member after ejection or non-ejection of droplets from nozzles of the head is detected by detection of electric changes of the electrode member generated when the droplets ejected from the nozzles land on the electrode member with a potential difference created between a nozzle face of the head and the electrode member and the nozzle face opposed to the electrode member. The cleaner includes a wiping member to wipe droplets adhering to the electrode member. The wiping member and the electrode member are configured to be relatively moved in parallel to a nozzle array direction to clean the electrode member.

19 Claims, 33 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application Nos. 2012-251593, filed on Nov. 15, 2012, and 2013-021840, filed on Feb. 6, 2013, in the Japan Patent Office, the entire disclosure of each of which is hereby incorporated by reference herein.

BACKGROUND

1. Technical Field

This disclosure relates to an image forming apparatus.

2. Description of the Related Art

Image forming apparatuses are used as printers, facsimile machines, copiers, plotters, or multi-functional devices having at least one of the foregoing capabilities. As one type of image forming apparatus employing a liquid-ejection recording method, inkjet recording apparatuses are known that use a recording head (liquid ejection head or liquid-droplet ejection head) for ejecting droplets of ink or other liquid.

For example, a liquid-ejection type image forming apparatus has an ejection detector to detect a state of droplet ejection from a recording head. When faulty droplet ejection is detected on a nozzle(s), the image forming apparatus performs maintenance and recovery operation (maintenance operation) on the recording head, such as cleaning of a nozzle face.

For example, an ejection detector detects ejection or non-ejection by measuring an electric change when liquid droplets ejected from a recording head land on an electrode board (JP-2007-050533-A).

JP-2004-306475-A proposes to clean such an electrode board by a wiping member to wipe the plate in the same direction as a moving direction of a carriage.

For the above-described configuration in which detection or non-detection is detected based on an electric change generated by liquid droplets ejected onto an electrode board, liquid droplets adhere to the electrode board in the detection of droplet ejection. Such liquid droplets ejected from nozzles of the recording head in the detection of droplet ejection are a minute amount of droplets.

Thus, as described in JP-2004-306475-A, even when a wiping member wipes the electrode board in the same direction as the moving direction of the carriage, that is, in a direction perpendicular to a nozzle array direction in which nozzles are arrayed in the recording head, droplets may not be collected on the electrode board and may separately adhere the wiping member.

As a result, waste liquid adhering to the wiping member may solidify and the wiping performance of the wiping member may decrease, thus hampering cleaning of the electrode board and accurate ejection detection.

BRIEF SUMMARY

In at least one exemplary embodiment of this disclosure, there is provided an image forming apparatus including a recording head, an ejection detector, and a cleaner. The recording head has a plurality of nozzles to eject droplets and a nozzle face in which the plurality of nozzles is formed. The ejection detector detects ejection or non-ejection of the droplets from the recording head. The ejection detector has an electrode member disposed in an area in which the electrode member is opposable to the recording head. The droplets ejected from the plurality of nozzles of the recording head land on the electrode member. The cleaner cleans the electrode member after ejection or non-ejection of the droplets from the plurality of nozzles is detected by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member. The cleaner includes a wiping member to wipe the droplets adhering to the electrode member. The wiping member and the electrode member are configured to be relatively moved in parallel to a nozzle array direction in which the plurality of nozzles is arrayed, to clean the electrode member.

In at least one exemplary embodiment of this disclosure, there is provided an image forming apparatus including a recording head and a cleaner. The recording head has a plurality of nozzles to eject droplets and a nozzle face in which the plurality of nozzles is formed. The cleaner cleans the electrode member after the droplets ejected from the plurality of nozzles of the recording head land on the electrode member in a state in which a potential difference is created between the nozzle face of the recording head and the electrode member and the nozzle face of the recording head is opposed to the electrode member. The cleaner includes a wiping member to wipe the droplets adhering to the electrode member. The wiping member and the electrode member are configured to be relatively moved in parallel to a nozzle array direction in which the plurality of nozzles is arrayed, to clean the electrode member.

In at least one exemplary embodiment of this disclosure, there is provided an image forming apparatus including a recording head, an ejection detector, and a cleaner. The recording head has a plurality of nozzles to eject droplets and a nozzle face in which the plurality of nozzles is formed. The ejection detector detects ejection or non-ejection of the droplets from the recording head. The ejection detector has an electrode member disposed in an area in which the electrode member is opposable to the recording head. The droplets ejected from the plurality of nozzles of the recording head land on the electrode member. The cleaner cleans the electrode member after ejection or non-ejection of the droplets from the plurality of nozzles is detected by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member. The cleaner includes a wiping member and a cleaning member. The wiping member wipes the droplets adhering to the electrode member. The wiping member and the electrode member are configured to be relatively moved in parallel to a nozzle array direction in which the plurality of nozzles is arrayed, to clean the electrode member. The cleaning member removes waste liquid adhering to the wiping member to clean the wiping member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
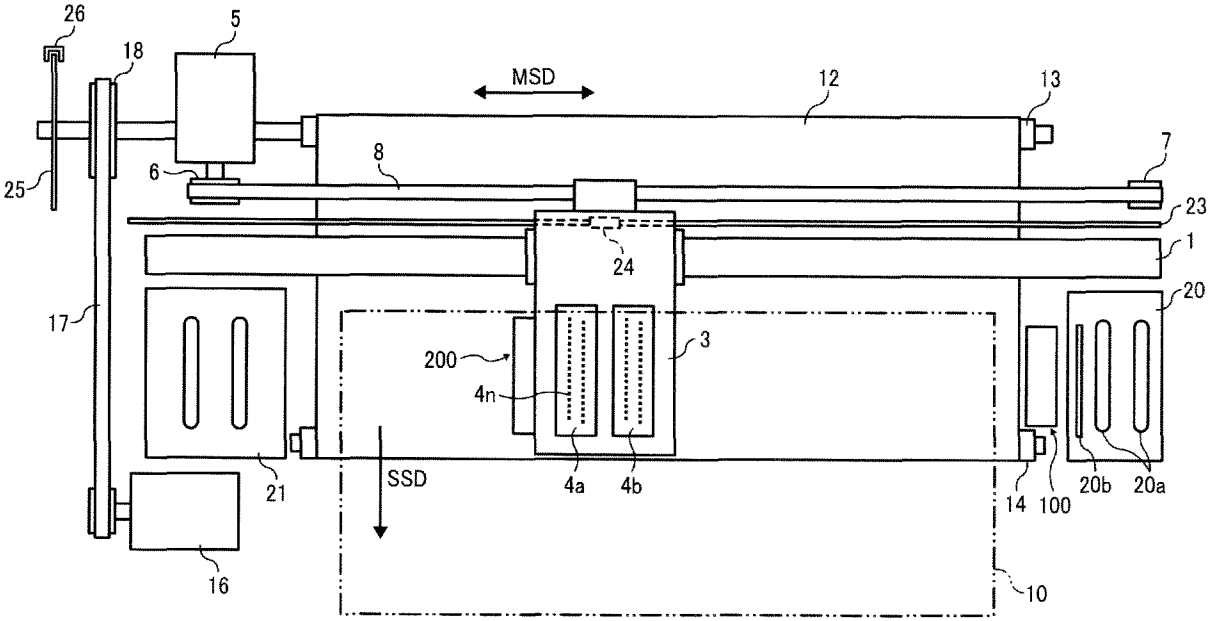
FIG. 1 s a plan view of a mechanical section of an image forming apparatus according to some exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Next, an image forming apparatus according to some exemplary embodiments of this disclosure is described below with reference to FIG. 1.

FIG. 1 is a partial plan view of a mechanical section of an image forming apparatus according to some exemplary embodiments of this disclosure.

In FIG. 1, the image forming apparatus is a serial-type inkjet recording apparatus. In the image forming apparatus, a carriage 3 is supported by a main guide rod 1 and a sub guide rod so as to be movable in a direction (main scanning direction) indicated by an arrow MSD in FIG. 1. The main guide rod 1 and the sub guide rod extend between left and right side plates. A main scanning motor 5 reciprocally moves the carriage 3 for scanning in the main scanning direction MSD via a timing belt 8 extending between a driving pulley 6 and a driven pulley 7.

The carriage 3 mounts recording heads 4*a* and 4*b* (collectively referred to as "recording heads 4" unless distinguished) serving as liquid ejection heads for ejecting liquid droplets. The recording heads 4 eject, for example, ink droplets of different colors, such as yellow (Y), cyan (C), magenta (M), and black (K). The carriage 3 mounts the recording heads 4 so that nozzle rows, each of which includes multiple nozzles 4*n*, are arranged in a sub scanning direction (indicated by an arrow SSD in FIG. 1) perpendicular to the main scanning direction MSD and ink droplets are ejected downward from the nozzles.

Figure 2:
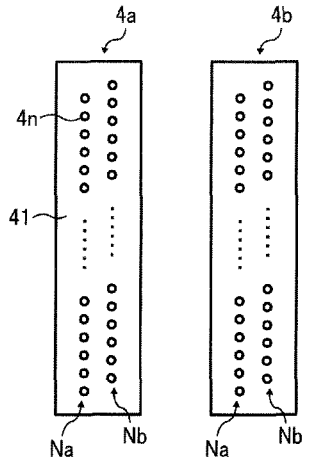
FIG. 2 is a schematic view of recording heads of an image forming apparatus according to some exemplary embodiments of this disclosure.

As illustrated in FIG. 2, each recording head 4 has two nozzle rows Na and Nb, each of which is formed of multiple nozzles 4*n*. For example, one (nozzle row Na) of the nozzle rows of the recording head 4*a* ejects droplets of black (K), and the other (nozzle row Nb) ejects droplets of cyan (C). One (nozzle row Na) of the nozzle rows of the recording head 4*a* ejects droplets of magenta (M), and the other (nozzle row Nb) ejects droplets of yellow (Y).

For example, piezoelectric actuators such as piezoelectric elements or thermal actuators that generate film boiling of liquid (ink) using electro/thermal converting elements, such as heat-generation resistant bodies, to cause a phase change may be employed as the liquid ejection heads forming the recording heads 4.

The image forming apparatus has a conveyance belt 12 serving as a conveyance device to convey a sheet 10 at a position opposing the recording heads 4 while adhering the sheet 10 thereon by static electricity. The conveyance belt 12 is an endless belt that is looped between a conveyance roller 13 and a tension roller 14.

The conveyance roller 13 is rotated by a sub-scanning motor 16 via a timing belt 17 and a timing pulley 18 to circulate the conveyance belt 12 in the sub-scanning direction SSD illustrated in FIG. 1. A charging roller charges (supplies electric charges to) the conveyance belt 12 during circulation.

At one end in the main scanning direction MSD of the carriage 3, a maintenance assembly (maintenance-and-recovery assembly) 20 is disposed near a lateral side of the conveyance belt 12 to perform maintenance and recovery on the recording heads 4. At the opposite end in the main scanning direction MSD, a first dummy ejection receptacle 21 is disposed at the opposite lateral side of the conveyance belt 12 to receive liquid droplets ejected from the recording heads 4 by dummy ejection in which liquid droplets not contributing to image formation are ejected for maintenance, e.g., removal of viscosity-increased liquid or bubbles.

The maintenance assembly 20 includes cap members 20*a* to cap, for example, nozzle faces (nozzle formed faces) of the recording heads 4, a wiper member 20*b* to wipe the nozzle faces, and a second dummy ejection receptacle to store liquid droplets not contributing to image formation.

An ejection detection unit 100 serving as an ejection detector according to an exemplary embodiment of this disclosure is disposed in an area outside a recording region between the conveyance belt 12 and the maintenance assembly 20, in which the ejection detection unit 100 can oppose the recording heads 4. The carriage 3 has a cleaning unit 200 to clean an electrode board 101 of the ejection detection unit 100.

An encoder scale 23B having a predetermined pattern extends between the side plates along the main scanning direction MSD of the carriage 3, and the carriage 3 has a main-scanning encoder sensor 24 serving as a transmissive photosensor to read the pattern of the encoder scale 23. The encoder scale 23 and the main-scanning encoder sensor 24 form a linear encoder (main scanning encoder) to detect movement of the carriage 3.

A code wheel 25 is mounted on a shaft of the conveyance roller 13, and a sub-scanning encoder sensor 26 serving as a transmissive photosensor is provided to detect a pattern of the code wheel 25. The code wheel 25 and the sub-scanning encoder sensor 26 form a rotary encoder (sub scanning encoder) to detect the movement amount and movement position of the conveyance belt 12.

In the image forming apparatus having the above-described configuration, a sheet 10 is fed from a sheet feed tray, attached on the conveyance belt 12 charged, and conveyed in the sub-scanning direction SSD with the circulation of the conveyance belt 12. By driving the recording heads 4 in response to image signals while moving the carriage 3 in the main scanning direction MSD, ink droplets are ejected onto the sheet 10 stopped to form one line of a desired image. Then, the sheet 10 is fed by a certain distance to prepare for the next operation to record another line of the image. Receiving a signal indicating that the image recording has been completed or a rear end of the sheet 10 has arrived at the recording region, the image forming apparatus finishes the recording operation and outputs the sheet 10 to a sheet output tray.

Next, an outline of a controller of the image forming apparatus according to an exemplary embodiment is described with reference to FIG. 3.

Figure 3:
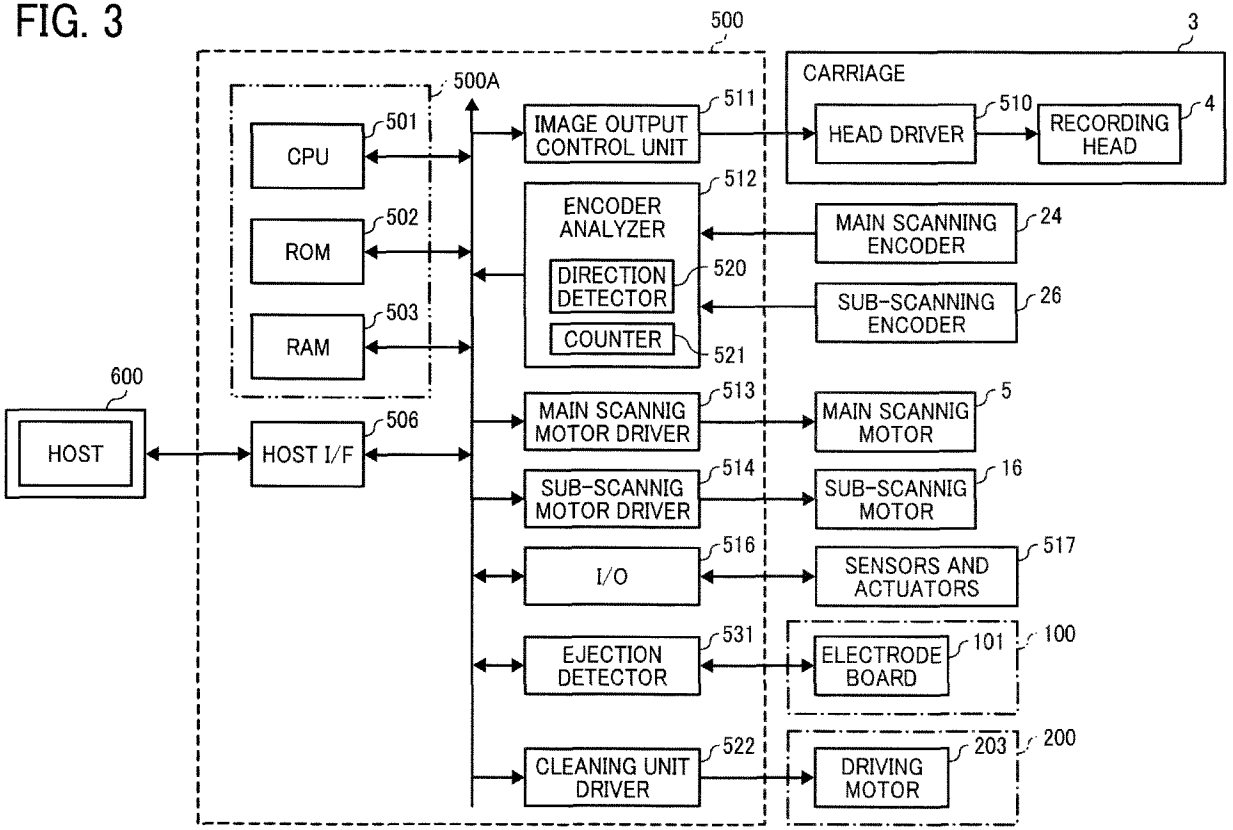
FIG. 3 is a block diagram of a controller of an image forming apparatus according to some exemplary embodiments of this disclosure.

FIG. 3 is a block diagram of a controller 500 of the image forming apparatus.

The controller 500 has a main control unit 500A. The main control unit 500A includes a central processing unit (CPU) 501, a read-only memory (ROM) 502, and a random access memory (RAM) 503. The CPU 501 controls the entire image forming apparatus. The ROM 502 stores programs executed by the CPU 501 and other fixed data. The RAM 503 temporarily stores image data and other data.

The controller 500 has a host interface (I/F) 506 to transmit and receive data to and from a host (information processing device) 600, such as a personal computer (PC), an image output control unit 511 to control driving of the recording heads 4, and an encoder analyzer 512. The encoder analyzer 512 receives and analyzes detection signals from the main-scanning encoder sensor 24 and the sub-scanning encoder sensor 26.

The controller 500 includes a main-scanning motor driver 513 to drive the main scan motor 5, a sub scanning motor driver 514 to drive the sub-scanning motor 16, and an input/output (I/O) unit 516 between various sensors and actuators 517.

The controller 500 also includes an ejection detector 531 to measure (detect) electric changes caused when liquid droplets land on an electrode board 101 of the ejection detection unit 100 to determine ejection or non-ejection. The controller 500 further includes a cleaning unit driver 522 to drive a driving motor 203 of the cleaning unit 200 to wipe the electrode board 101 of the ejection detection unit 100.

The image output control unit 511 includes a data generator to generate print data, a driving waveform generator to generate driving waveforms to control driving of the recording heads 4, and a data transmitter to transmit print data and head control signals for selecting desired driving signals from the driving waveforms. The image output control unit 511 outputs the driving waveforms, the head control signals, print data and so on to a head driver 51, which is a head driving circuit for driving the recording heads 4 mounted on the carriage 3, to eject liquid droplets from nozzles of the recording heads 4 in accordance with print data.

The encoder analyzer 512 includes a direction detector 520 to detect a movement direction of the carriage 3 from detection signals and a counter 521 to detect a movement amount of the carriage 3.

Based on analysis results transmitted from the encoder analyzer 512, the controller 500 controls driving of the main scan motor 5 via a the main scanning motor driver 513 to control movement of the carriage 3. The controller 500 also controls driving of the sub-scanning motor 16 via a sub scanning motor driver 514 to control feeding of the sheet 10.

In detection of ejection of droplets from the recording heads 4, the main control unit 500A of the controller 500 controls the recording heads 4 to move and eject droplets from desired nozzles of the recording heads 4, and determines droplet ejection states based on detection signals from the ejection detector 531.

Next, an exemplary embodiment of this disclosure is described with reference to FIGS. 4 to 6.

Figure 4:
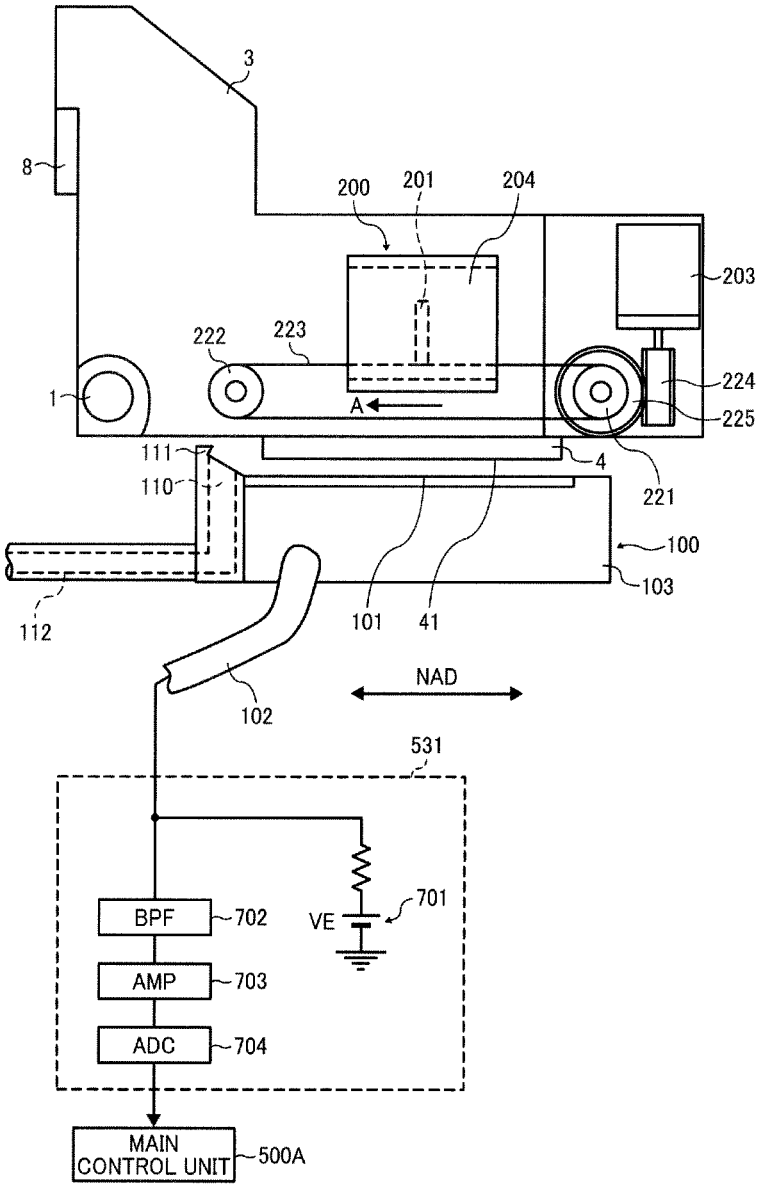
FIG. 4 is a schematic view of lateral faces of a carriage section and an ejection detection unit and a block circuit of an ejection detection unit according to some exemplary embodiments of this disclosure.

FIG. 4 is a schematic view of lateral faces of a carriage section and an ejection detection unit and a block circuit of an ejection detector according to an embodiment of this disclosure. FIG. 5 is a partial perspective view of the carriage section and the ejection detection unit of FIG. 4. FIG. 6 is a partial front view of the carriage section and the ejection detection unit of FIG. 4.

An ejection detection unit 100 includes a holder member 103 and an electrode board 101. The electrode board 101 serving as an electrode member is disposed on an upper face of the holder member 103 to oppose a nozzle face 41 of a recording head 4.

The holder member 103 is made of an insulation material, such as plastic.

The electrode board 101 is preferably, for example, a conductive metal plate made of a material which is rustproof and resistant to ink. The electrode board 101 may be, for example, stainless steel (SUS) 304 or copper alloy plated with nickel (Ni) or palladium (Pd). A surface of the electrode board 101 on which liquid droplets land is preferably finished to be water repellent.

The electrode board 101 is electrically connected to a lead wire 102. More specifically, the lead wire 102 is connected to the ejection detector 531.

Figure 7:
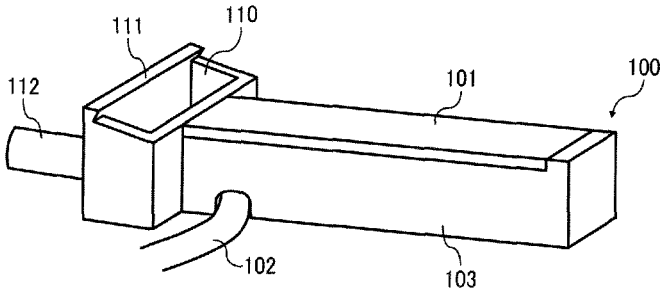
FIG. 7 is a perspective view of the ejection detection unit of FIG. 4

As illustrated in FIG. 7, the holder member 103 has an opening 110 at a terminal end side in a wiping direction of a wiping member 202. A portion (edge portion) of the holder member 103 forming the opening 110 also forms a wiper cleaner 111 serving as a cleaning member to remove and clean waste liquid (liquid droplets adhering to the wiping member 202) from the wiping member 202.

The holder member 103 has a waste-liquid tube 112 forming a channel connected to a waste liquid tank from a lower side of the opening 110. A suction pump is provided on the channel connected to the waste liquid tank to discard waste liquid accumulated on a bottom portion of the opening 110 into the waste liquid tank.

The carriage 3 includes a cleaning unit 200 serving as a cleaner including the wiping member 202 to wipe liquid droplets adhering to a surface of the electrode board 101.

The wiping member 202 is made of, for example, ethylene propylene diene monomer rubber (EPDM), EPDM is not so highly water repellent, and the water repellency of the electrode board 101 can be set to be higher than the water repellency of the wiping member 202. Setting the water repellency of the electrode board 101 to be higher than the water repellency of the wiping member 202 facilitates wiping out of ink from the electrode board 101.

The wiping member 202 is mounted on a timing belt 223 wound around a driving pulley 221 and a driven pulley 222. When the driving pulley 221 is rotated by the driving motor 203 serving as a driving source mounted on the carriage 3 via a worm gear 224 and a gear 225, the wiping member 202 is circulated with the timing belt 223 in a direction indicated by an arrow A in FIG. 4.

A wiper retraction cover 204 is provided to cover the wiping member 202 at a retracted position. When the wiping member 202 is not used, the wiping member 202 is accommodated in the wiper retraction cover 204. Such a configuration can prevent a slight amount of waste liquid adhering to the wiping member 202 to be scattered during operation of the carriage 3.

Figure 8:
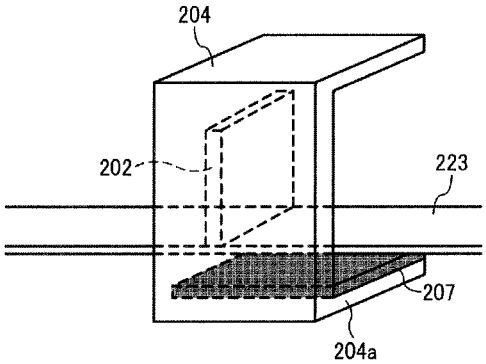
FIG. 8 is a perspective view of a wiper retraction cover according to some exemplary embodiments of this disclosure.

As illustrated in FIG. 8, the wiper retraction cover 204 has a lower face serving as a waste-liquid receiver 204*a* to receive waste liquid dripping from the wiping member 202 and an absorbing member 207 is provided on the waste-liquid receiver 204*a* to absorb and retain waste liquid.

Here, a dimensional relation between liquid droplets for ejection detection, the electrode board, the wiping member, the opening, and a wiper cleaner according to some exemplary embodiments of this disclosure is described with reference to FIG. 9.

Figure 9:
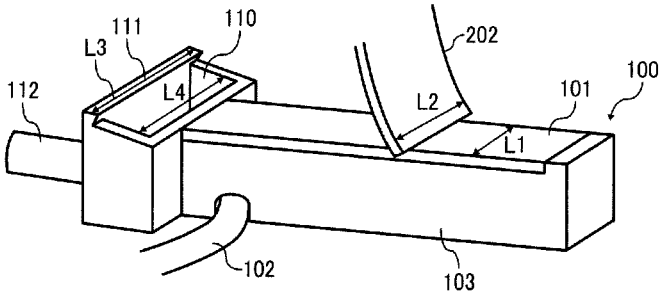
FIG. 9 is a perspective view of an ejection detection unit with a dimensional relation between liquid droplets for ejection detection, an electrode board, a wiping member, an opening, and a wiper cleaner according to some exemplary embodiments of this disclosure.

FIG. 9 is a schematic view of an ejection detection unit 100 according to some exemplary embodiments of this disclosure.

The width L1 of the electrode board 101 (the width of the electrode board 101 in a direction perpendicular to a nozzle array direction indicated by an arrow NAD in which nozzles are arrayed) is greater than a diameter D of liquid droplets for ejection detection (D<L1). In such a case, the width L1 of the electrode board 101 is preferably set to be sufficiently greater than the diameter D of the liquid droplets for ejection detection in consideration of, e.g., the accuracy of landing positions of liquid droplets, the accuracy of stop positions of the carriage 3, the precision of components.

In FIGS. 9A to 9C, since two nozzle rows Na and Nb of each recording head 4 are configured to perform detection ejection at the same stop position of the carriage, the width L1 of the electrode board 101 is set to be greater than a value of the diameter D of liquid droplets and an inter-row distance between the nozzle row Na and the nozzle row Nb.

The width L2 of the wiping member 202 is greater than the width L1 of the electrode board 101 (L1<L2). Such a configuration can reduce residue droplets of the electrode board 101 not wiped by the wiping member 202.

The width L3 of the wiper cleaner 111 is greater than the width L2 of the wiping member 202 (L2<L3). Such a configuration can reliably wipe off waste droplets adhering to the wiping member 202 to clean the wiping member 202.

The width L4 of the opening 110 is greater than the width L2 of the wiping member 202 (L2<L4). Such a configuration allows an entire region of the wiping member 202 in the width direction of the wiping member 202 to be disposed within the opening 110, thus preventing scattering of waste droplets.

Next, an example of the ejection detector 531 is described with reference to FIG. 4.

As illustrated in FIG. 4, the ejection detector 531 has a high-voltage power source 701 to supply a high voltage VE (e.g., 750V) to the electrode board 101. The main control unit 500A control on and off states of the high-voltage power source 701.

The ejection detector 531 also has a band pass filter (BPF) 702 to input signals involving electric changes when liquid droplets land on the electrode board 101, an amplification (AMP) circuit 703 to amplify the signals, and an analog-digital converter (ADC) 704 to convert the amplified signals from analog format to digital format. Resultant converted signals of the ADC 704 are input to the main control unit 500A.

When ejection detection is performed, the nozzle face 41 of one of the recording heads 4 is placed to oppose the electrode board 101. A high voltage VE is supplied to the electrode board 101 to generate a potential difference between the nozzle face 41 and the electrode board 101. At this time, the nozzle face 41 of the recording head 4 is negatively charged while the electrode board 101 is positively charged.

In such a state, a liquid droplet(s) for ejection detection is (are) ejected from each nozzle of the recording heads 4.

At this time, since liquid droplets are ejected from the nozzle face 41 negatively charged, the liquid droplets are also negatively charged. When the liquid droplets negatively charged land on the electrode board 101, the voltage of he high voltage VE supplied to the electrode board 101 slightly changes.

The band-pass filter 702 extracts the voltage change (alternative current (AC) component) and the amplification circuit 703 amplifies the AC component. The ADC 704 converts the amplified component from analog format to digital format and inputs the converted data as a measurement result (detection result) to the main control unit 500A.

The main control unit 500A determines whether the measurement result (voltage change) is greater than a preset threshold value, and if the measurement result is greater than the threshold value, the main control unit 500A determines that a detected nozzle of the recording heads 4 has ejected a liquid droplet(s). By contrast, if the measurement result is not greater than the threshold value, the main control unit 500A determines that a detected nozzle of the recording heads 4 has not ejected a liquid droplet(s).

In this exemplary embodiment, since a liquid droplet(s) is (are) ejected from each nozzle of the recording heads 4 to land on the electrode board 101, it takes approximately 0.5 to 10 msec to determine ejection or non-ejection of a single nozzle. After ejection or non-ejection of all nozzles is determined, the high voltage VE supplied to the electrode board 101 is turned into off state.

Next, ejection detection control and cleaning control performed by the controller according to some exemplary embodiments of this disclosure is described with reference to FIGS. 10 to 18.

Figure 10:
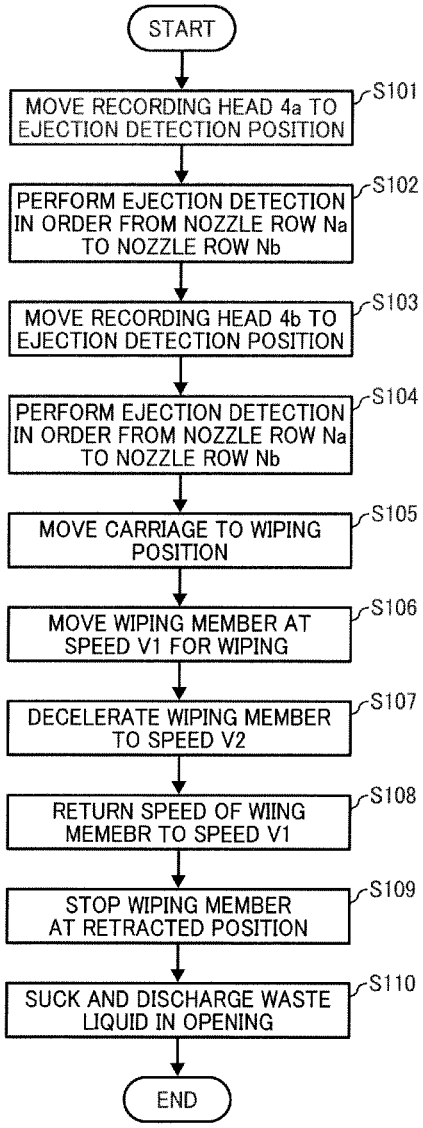
FIG. 10 is a flowchart of ejection detection control and cleaning control performed by a controller according to some exemplary embodiments of this disclosure.
Figure 11:
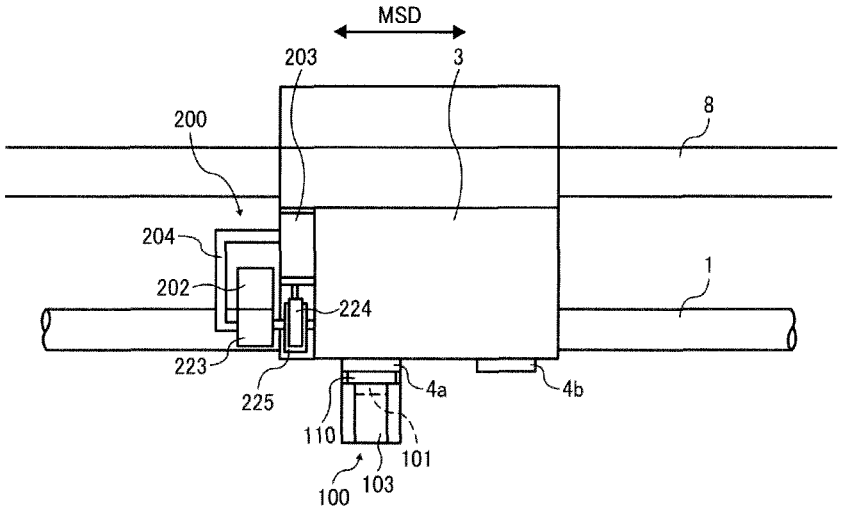
FIG. 11 is a front view of a carriage section and an ejection detection unit according to some exemplary embodiment of this disclosure.

At S101 of FIG. 10, the carriage 3 is moved to a position at which the nozzle face 41 of the recording head 4*a* opposes the electrode board 101 as illustrated in FIG. 11. At S102, ejection detection is performed by ejecting liquid droplets for ejection detection from the nozzle row Na of the recording head 4*a* and ejecting liquid droplets for ejection detection from the nozzle row Nb of the recording head 4*a*.

Figure 12:
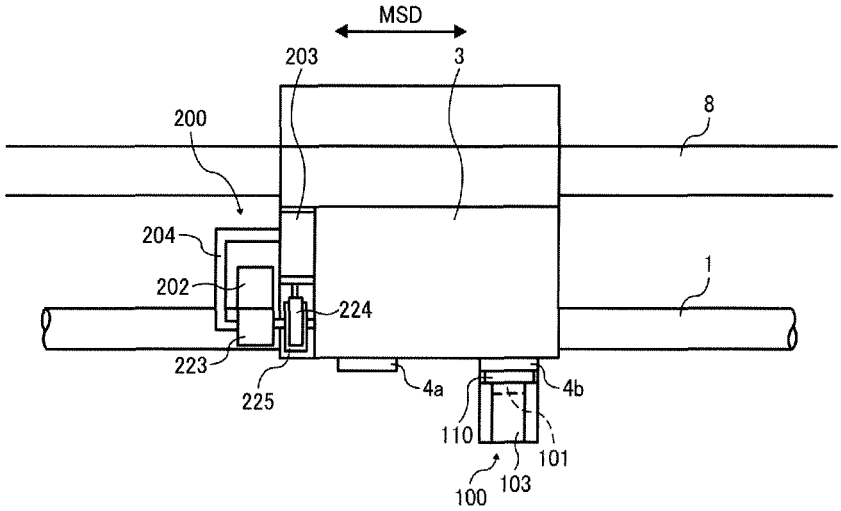
FIG. 12 is a front view of the carriage section and the ejection detection unit of FIG. 11 in a different state.

At S103, the carriage 3 is moved to a position at which the nozzle face 41 of the recording head 4*b* opposes the electrode board 101 as illustrated in FIG. 12. At S104, ejection detection is performed by ejecting liquid droplets for ejection detection from the nozzle row Na of the recording head 4*b* and ejecting liquid droplets for ejection detection from the nozzle row Nb of the recording head 4*b*.

Figure 6:
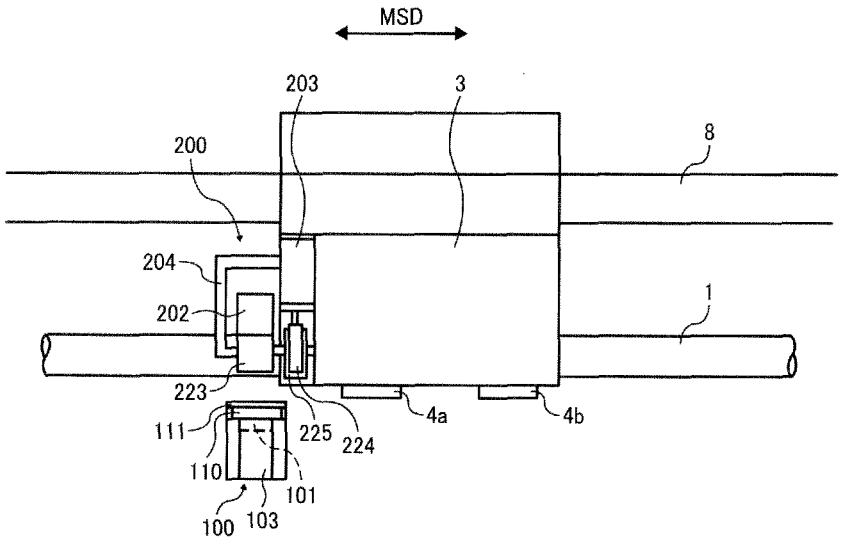
FIG. 6 is a partial front view of the carriage section and the ejection detection unit of FIG. 4.

After ejection detection is finished, at S105 the carriage 3 is moved to a cleaning position (wipable position) at which the cleaning unit 200 opposes the electrode board 101 as illustrated in FIG. 6.

Figure 5:
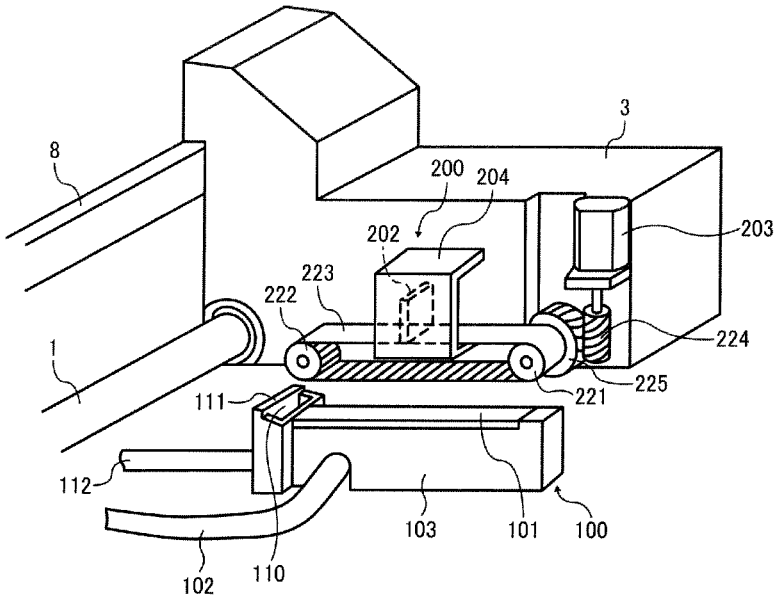
FIG. 5 is a partial perspective view of the carriage section and the ejection detection unit of FIG. 4.
Figure 13:
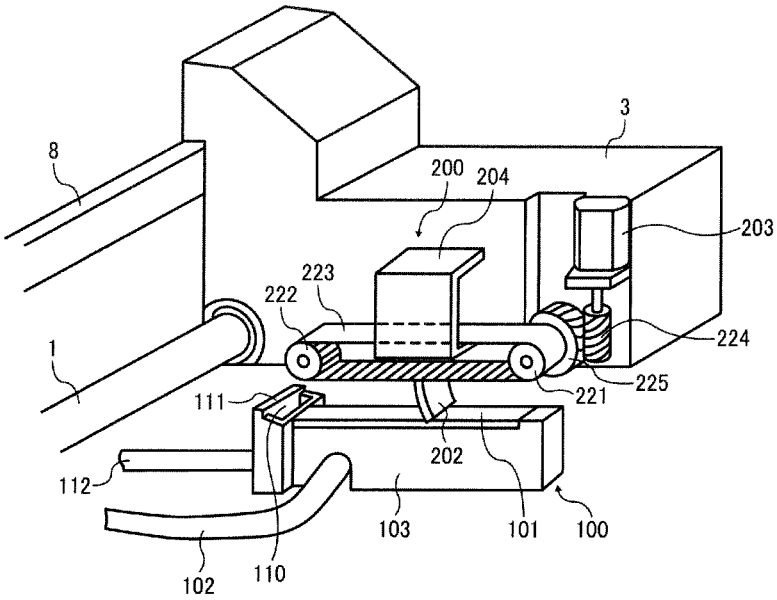
FIG. 13 is a perspective view of the carriage section and the ejection detection unit of FIG. 11.
Figure 14:
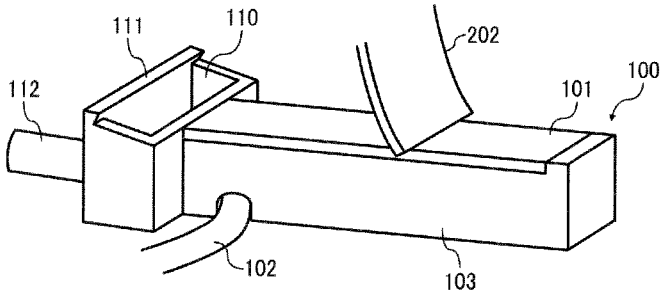
FIG. 14 is a perspective view of the carriage section and the ejection detection unit of FIG. 11.

At S106, as illustrated in FIGS. 13 and 14, the driving motor 203 is driven to move he wiping member 202, which is placed at the retracted position illustrated in FIG. 5, at a speed V1 (in the direction indicated by the arrow A in FIG. 4) to wipe a surface of the electrode board 101 with the wiping member 202. At this time, the moving speed V1 of the wiping member 202 is, for example, approximately 50 to 200 min/sec.

Figure 15:
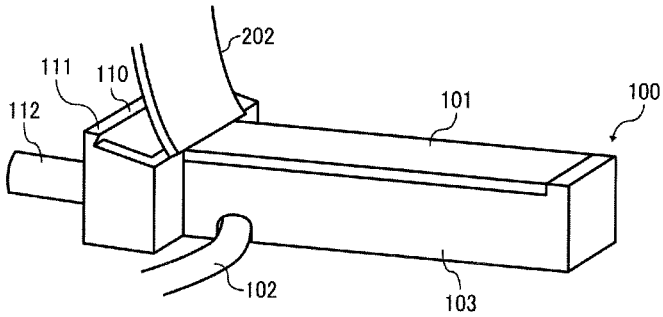
FIG. 15 is a perspective view of the carriage section and the ejection detection unit of FIG. 11.

Here, as illustrated in FIG. 15, when the wiping member 202 is about to finish wiping the electrode board 101, at S107 the moving speed of the wiping member 202 is reduced to a speed V2 (V2<V1). Such a configuration can prevent scattering of waste droplets adhering to the wiping member 202. At this time, the moving speed V2 of the wiping member 202 is, for example, approximately 20% to 80% of the moving speed V1.

Figure 16:
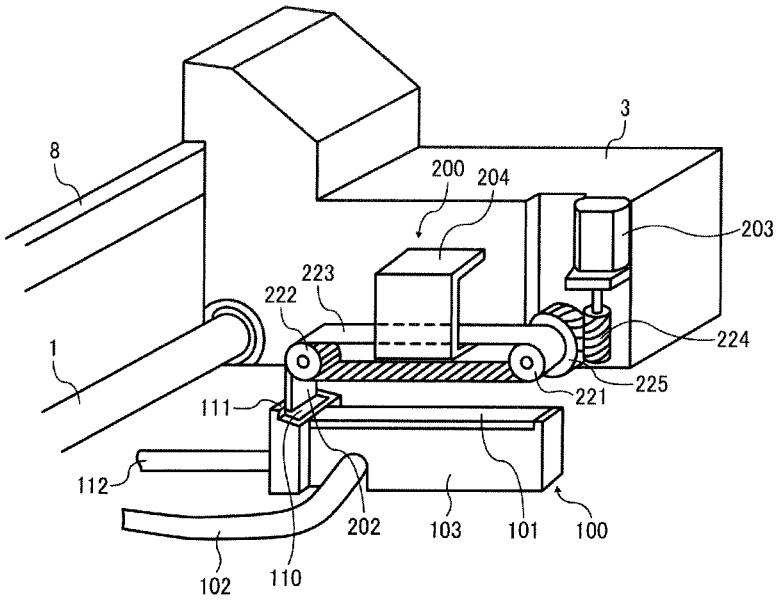
FIG. 16 is a perspective view of the carriage section and the ejection detection unit of FIG. 11.
Figure 17:
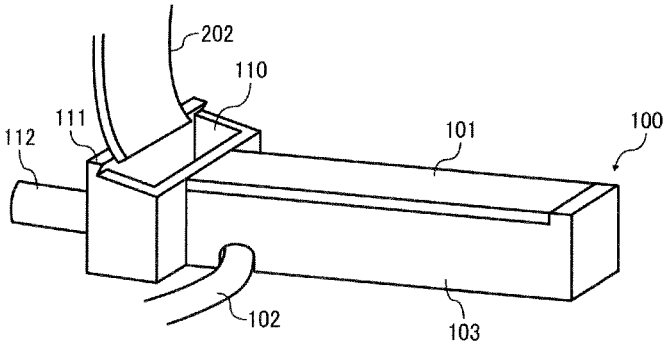
FIG. 17 is a perspective view of the carriage section and the ejection detection unit of FIG. 11.

As illustrated in FIGS. 16 and 17, the wiping member 202 hits and contacts the wiper cleaner 111 and waste liquid adhering to the wiping member 202 is scraped off by the wiper cleaner 111.

Figure 18:
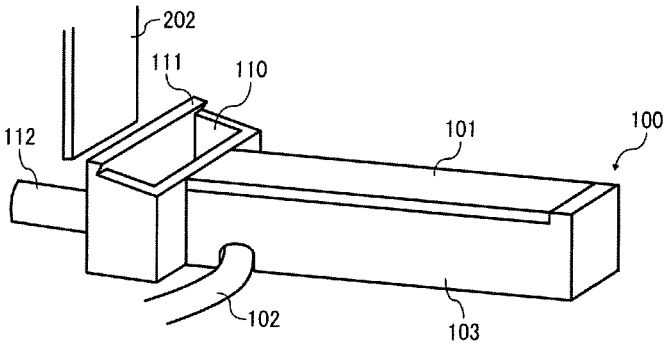
FIG. 18 is a perspective view of the carriage section and the ejection detection unit of FIG. 11.

At S108, as illustrated in FIG. 18, when the wiping member 202 has passed the wiper cleaner 111, the moving speed of the wiping member 202 is returned to the speed V1. Such a configuration allows the wiping member 202 to be quickly returned to the retracted position. When the wiping member 202 has returned to retracted position at which the wiping member 202 is covered with the wiper retraction cover 204, at S109 the driving motor 203 is stopped to stop the wiping member 202.

At S110, the suction pump is driven to suck and drain waste liquid, which is collected and stored in the opening 110, into the waste liquid tank.

In this exemplary embodiment, after ejection detection is performed all of the nozzles of the nozzle rows Na and Nb of each of the recording heads 4*a* and 4*b*, wiping is performed on the electrode board 101. In some embodiments, ejection detection and wiping are performed on each recording head 4.

However, typically, since the amount of ink adhering to the electrode board by ejection detection on a single recording head is small and a large amount of ink is unlikely to be collected into the waste liquid tank by cleaning, waste liquid can be more effectively collected by cleaning the electrode board after ejection detection is performed on the nozzles of all colors once or multiple times.

Next, a wiping direction of a wiping member according to some exemplary embodiments of the present disclosure is described with reference to FIGS. 19A to 23C.

FIGS. 19A to 21 are schematic views of a wiping direction in a comparative example. FIGS. 22A to 23C are schematic views of a wiping direction of a wiping member in some exemplary embodiments of the present disclosure.

Figure 19A:
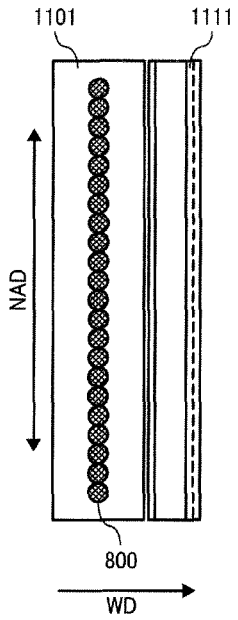
FIGS. 19A to 19C are plan views of a wiping direction of a wiper member according to a comparative example.

In the comparative example illustrated in FIGS. 19A to 19C and 20A to 20C, a wiping member 1202 and a wiper cleaner 1111 are formed so that a longitudinal direction of each of the wiping member 1202 and the wiper cleaner 1111 is parallel to a nozzle array direction indicated by an arrow NAD in FIG. 19A in which nozzles are arrayed in line.

Figure 19B:
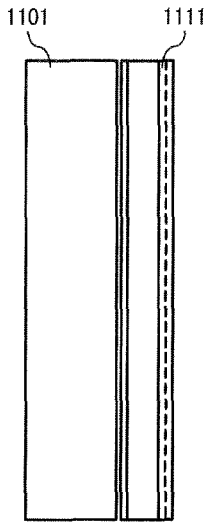
Figure 19C:
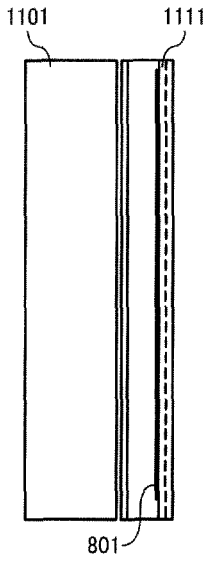
Figure 20A:
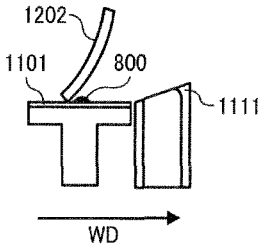
FIGS. 20A to 20C are front views of the comparative example.
Figure 20B:
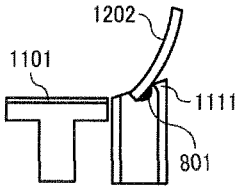
Figure 20C:
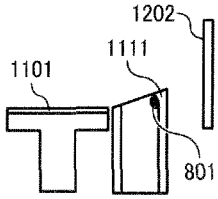

As illustrated in FIGS. 19A and 20A, liquid droplets for ejection detection 800 are ejected onto an electrode board 1101. Then, as illustrated in FIGS. 19B and 20B, the wiping member 1202 is moved in a wiping direction indicated by an arrow WD in FIG. 19A and 20A perpendicular to the nozzle array direction NAD to wipe the liquid droplets 800 on the electrode board 1101. When the wiping member 1202 is further moved as illustrated in FIGS. 19C and 20C, waste liquid 801 adhering to the wiping member 1202 is scraped off by the wiper cleaner 1111.

At this time, since the liquid droplets 800 are a micro droplet amount of liquid droplets and are wiped in the direction WD perpendicular to the nozzle array direction NAD, the liquid droplets 800 on the electrode board 1101 Accordingly, the waste liquid 801 adheres to an edge portion of the wiper cleaner 1111 in a linearly dispersed state.

As a result, the waste liquid 801 adhering to the edge portion of the wiper cleaner 1111 does not fall by its weight or is not moved by forceful suction, thus fixedly adhering to the edge portion.

When the next ejection detection operation is performed in such a state in which the waste liquid 801 fixedly adheres to the edge portion, similarly, additional waste liquid fixedly adheres to the edge portion so as to overlap the already-adhering waste liquid 801.

Figure 21:
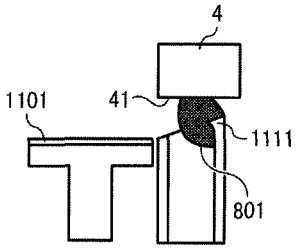
FIG. 21 is a front view of the comparative example.

As a result, when the waste liquid fixedly adhering to the edge portion of the wiper cleaner 1111 accumulates and grows, as illustrated in FIG. 21, the waste liquid contacts the nozzle face 41 of the recording head 4 and damages the menisci of the nozzle face 41 of the recording heads 4, thus hampering stable droplet ejection.

Figure 22A:
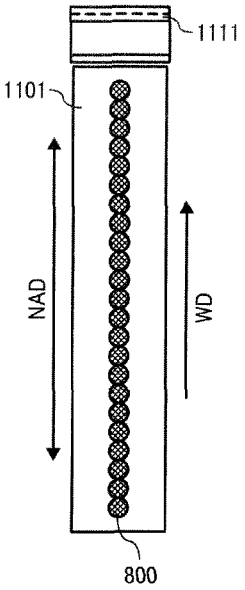
FIGS. 22A to 22C are plan views of a wiping direction of a wiper member according to some exemplary embodiments of this disclosure.
Figure 22B:
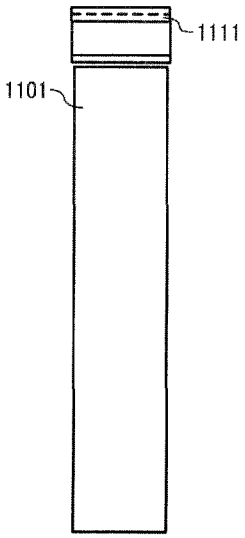
Figure 22C:
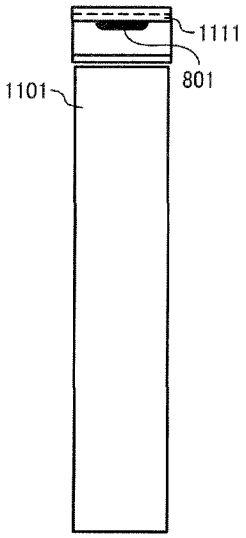
Figure 23A:
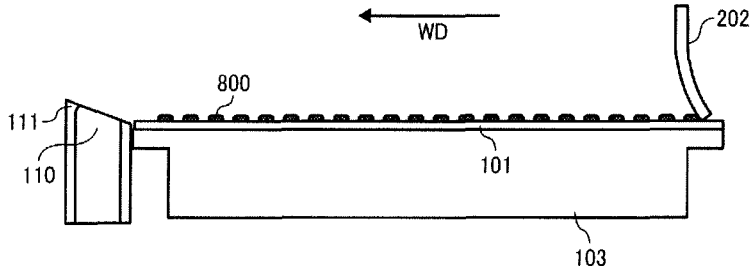
FIGS. 23A, 23B, and 23C are side views of the wiping direction of the wiping member of FIGS. 22A, 22B, and 22C, respectively.
Figure 23B:
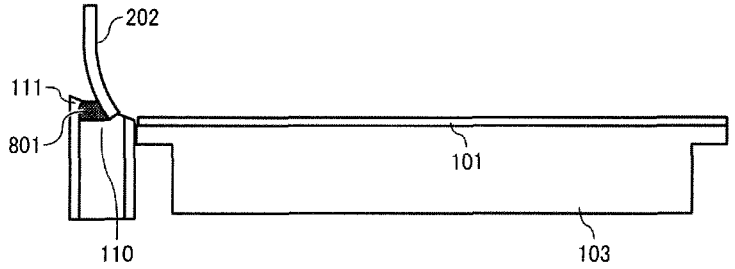
Figure 23C:
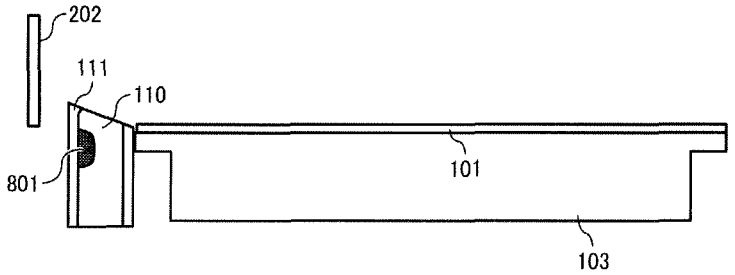

By contrast, in this exemplary embodiment, as illustrated in FIGS. 22A and 23A, liquid droplets for ejection detection 800 are ejected onto the electrode board 101. Then, as illustrated in FIGS. 22B and 23B, the wiping member 202 is moved in a nozzle array direction indicated by an arrow NAD in FIGS. 22A and 23A to wipe the liquid droplets 800 on the electrode board 101. The wiping member 202 is further moved as illustrated in FIGS. 22C and 23C, and the waste liquid 801 adhering to the wiping member 202 is scraped off by the wiper cleaner 111.

As described above, the liquid droplets 800 on the electrode board 101 is wiped by moving the wiping member 202 in the nozzle array direction NAD. As a result, as illustrated in FIGS. 22C and 23C, the waste liquid 801 adhering to the wiper cleaner 111 is collected to a single position.

Accordingly, the waste liquid 801 adhering to the edge portion of the wiper cleaner 111 can fall by its weight, thus reducing the waste liquid 801 fixedly adhering to and accumulated on the edge portion of the wiper cleaner 111. As a result, the waste liquid 801 can be easily discharged into the waste liquid tank by suction.

As described above, the wiping member and the electrode member are relatively moved in the direction parallel to the nozzle array direction to clean the electrode member. Such a configuration reduce fixedly adherence and accumulation of waste liquid in the cleaning member for cleaning the wiping member and the wiping member, thus suppressing deterioration of the wiping performance of the wiping member over time. As a result, droplet ejection detection can be performed at high accuracy.

Figure 24:
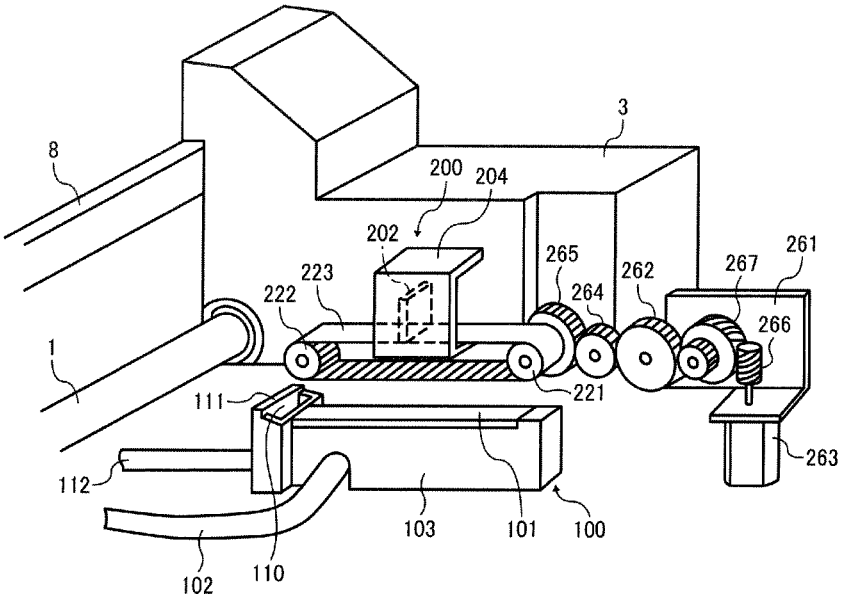
FIG. 24 is a perspective view of a carriage section and an ejection detection unit according to some exemplary embodiments of this disclosure.

Next, an exemplary embodiment of this disclosure is described with reference to FIG. 24. FIG. 24 is a perspective view of a carriage section and an ejection detection unit according to an exemplary embodiment of this disclosure.

In the above-described exemplary embodiment illustrated in FIGS. 4 to 6, the carriage 3 mounts the driving motor 203 serving as a driving source to move the wiping member 202. By contrast, in this exemplary embodiment, a driving motor 263 serving as a driving source is disposed at an apparatus body.

In other words, the driving motor 263 is mounted on a support member 261 that is disposed at the apparatus body. An idler gear 262 rotatably supported by the support member 261 is rotated via a worm gear 266 and a gear 267 rotated by driving motor 263.

The idler gear 262 is disengageably engaged with an idler gear 264 rotatably held on the carriage 3 so that the idler gear 262 is releasably interlocked with the idler gear 264. The idler gear 264 at the carriage 3 side is engaged with a gear 265 of the driving pulley 221.

When wiping operation is performed on the electrode board 101, the carriage 3 is moved to the wiping position to engage the idler gear 262 with the idler gear 264. By driving motor 263, the wiping member 202 is moved to wipe the electrode board 101.

As described above, in this exemplary embodiment, the driving motor for moving the wiping member is disposed at the apparatus body, thus allowing a weight reduction of the carriage.

Next, an exemplary embodiment of this disclosure is described with reference to FIG. 25.

Figure 25:
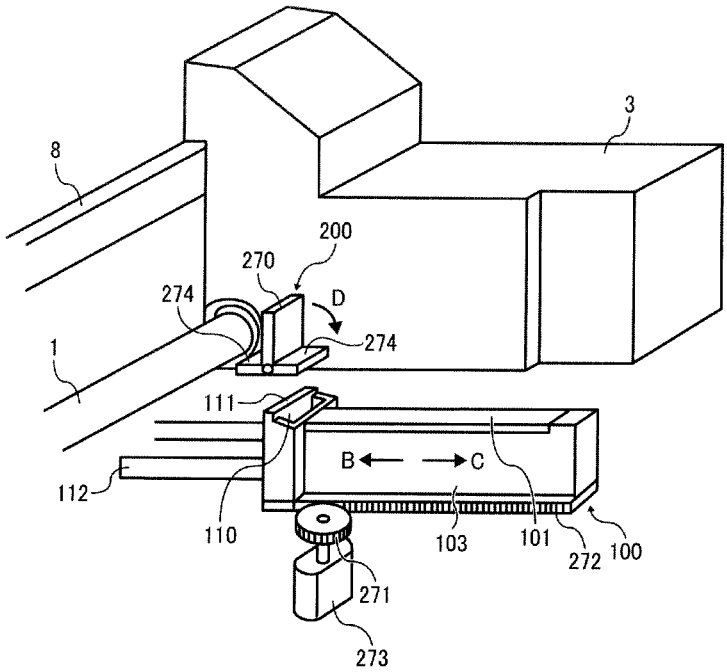
FIG. 25 is a perspective view of a carriage section and an ejection detection unit according to some exemplary embodiments of this disclosure.

FIG. 25 is a perspective view of a carriage section and an ejection detection unit according to an exemplary embodiment of this disclosure.

In this exemplary embodiment, an electrode board is moved relative to a wiping member to perform wiping.

In other words, an ejection detection unit 100 is disposed so as to be reciprocally movable along a nozzle array direction (a direction indicated by an arrow B and a direction indicated by an arrow C in FIG. 25). The ejection detection unit 100 is moved by a driving motor 273 serving as a moving unit via a pinion 271 and a rack 272 provided at a holder member 103.

By contrast, a wiping member 270 is disposed at the carriage 3 so as to be rotatable in a direction indicated by an allow D in FIG. 25. The wiping member 270 has a waste-liquid receiving member 274. The waste-liquid receiving member 274 also has an absorbing member.

When wiping operation is performed on the electrode board 101, the ejection detection unit 100 is moved in the direction indicated by the allow B to set a wiping start position of the electrode board 101 to a position opposing the wiping member 270. Then, the wiping member 270 is rotated in the direction indicated by the arrow D. Thus, the wiping member 270 hits and contacts a surface of the electrode board 101.

From such a state, the ejection detection unit 100 is moved in the direction indicated by an arrow C to wipe the electrode board 101 with the wiping member 270. After the electrode board 101 is wiped with the wiping member 270, the wiping member 270 is returned to a state illustrated in FIG. 25.

Such a configuration more facilitates a weight reduction of the carriage than the above-described exemplary embodiment illustrated in FIG. 24. However, this exemplary embodiment illustrated in FIG. 25 employs an actuator to rotate wiping member and a mechanism to move the ejection detection unit, and as a result, the number of actuators is greater than the above-described exemplary embodiment illustrated in FIGS. 4 to 6.

In the above-described exemplary embodiments, the electrode board (electrode member) is disposed outside the recording region (sheet conveyance region). However, it is to be noted that the position of the electrode member is not limited to the above-described position. For example, a configuration may be employed in which a sheet is conveyed with a conveyance roller disposed upstream from an image forming unit and a platen member having ribs in a recording region, thus allowing the electrode member to be disposed within the sheet conveyance region.

In the above-described exemplary embodiment, a serial-type image forming apparatus is described as an example of an image forming apparatus. However, the image forming apparatus may be a line-type image forming apparatus.

Moreover, in the above-described exemplary embodiment, the electrode member (electrode board) is used in the ejection detector. In some embodiments, the electrode member (electrode board) is used as a dummy ejection receptacle (a member to receive liquid droplets (dummy ejection droplets) not contributing to image formation).

In other words, a potential difference is created between the nozzle face of the recording head and the electrode member, and with the nozzle face of the recording head opposing the electrode member, dummy ejection droplets ejected from nozzles of the recording head land on the electrode member.

As described above, with the potential difference generated between the nozzle face of the recording head and the electrode member, dummy ejection is performed, thus reducing occurrence of mist.

In such a case, a cleaner is provided to clean the electrode member, the cleaner has the wiping member to wipe liquid droplets adhering to the electrode member, and the wiping member and the electrode member are relatively moved in a direction parallel to the nozzle array direction to clean the electrode member. Like exemplary embodiments, such a configuration can suppress deterioration of in the wiping performance over time.

It is to be noted that the above-described control of droplet ejection detection operation can be performed by a computer according to a program stored in, e.g., the ROM of the controller. The program may be provided as a recording medium storing the program therein or may be provided so as to be downloaded through a network, e.g., the Internet.

Next, an image forming apparatus according to some exemplary embodiments of this disclosure is described below with reference to FIG. 26.

Figure 26:
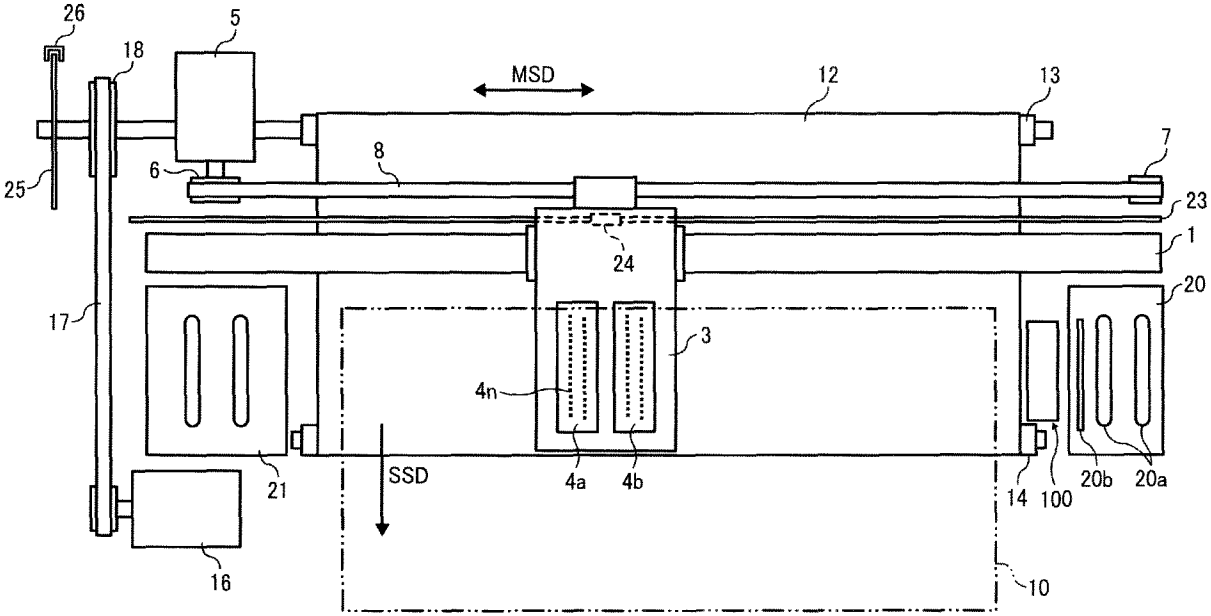
FIG. 26 is a plan view of a mechanical section of an image forming apparatus according to some exemplary embodiments of this disclosure.

FIG. 26 is a partial plan view of a mechanical section of an image forming apparatus according to some exemplary embodiments of this disclosure.

In the image forming apparatus illustrated in FIG. 26, as described below, an ejection detection unit 100 includes a cleaning unit 200 serving as a cleaner to clean an electrode member, as well as an ejection detector and a cleaning member. Except for the position of the cleaning unit 200, the image forming apparatus illustrated in FIG. 26 has the same configuration as the configuration of the image forming apparatus illustrated in FIG. 1. Therefore, redundant descriptions of the same components and elements are omitted here for simplicity.

Next, an outline of a controller of an image forming apparatus according to some exemplary embodiments of this disclosure is described with reference to FIG. 27.

Figure 27:
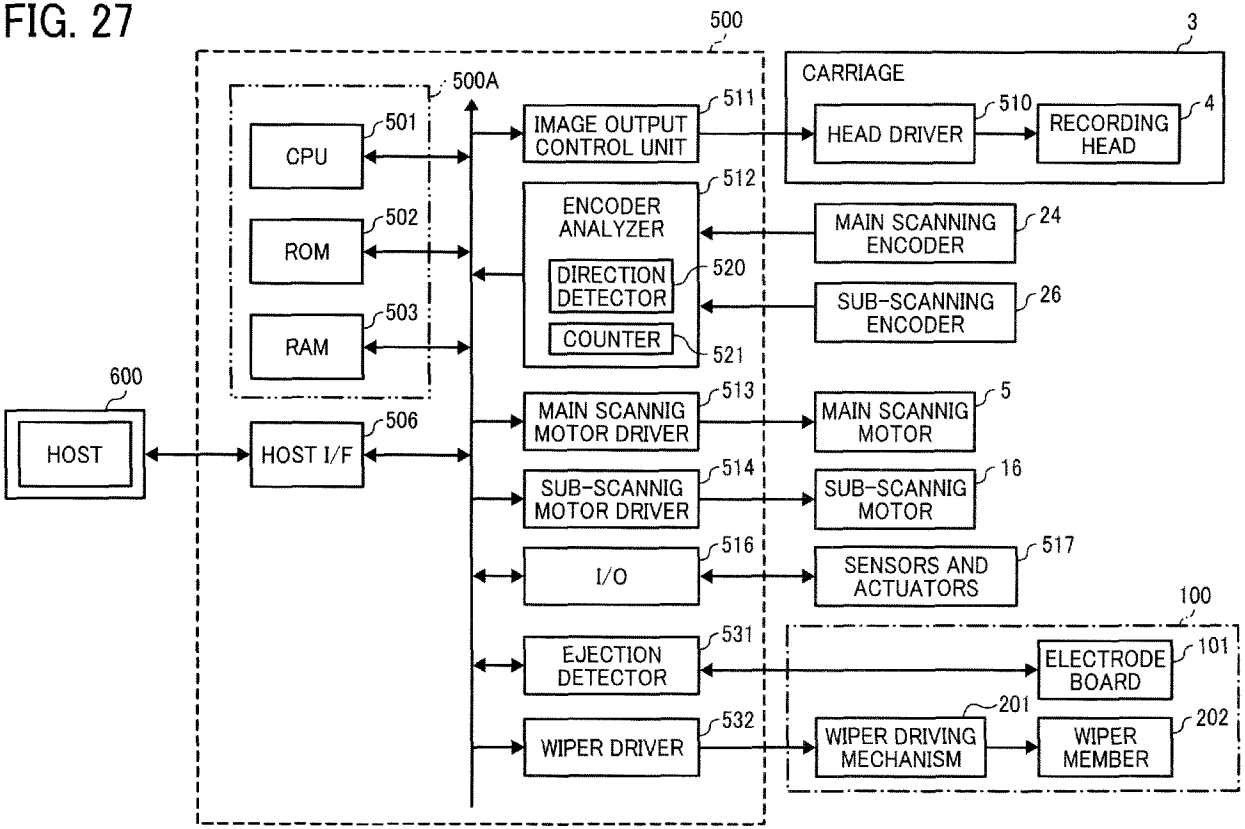
FIG. 27 is a block diagram of a controller of an image forming apparatus according to some exemplary embodiments of this disclosure.

FIG. 27 is a block diagram of a controller 500 of the image forming apparatus according to some exemplary embodiments of this disclosure.

The controller 500 has a main control unit 500A. The main control unit 500A includes a central processing unit (CPU) 501, a read-only memory (ROM) 502, and a random access memory (RAM) 503. The CPU 501 controls the entire image forming apparatus. The ROM 502 stores programs executed by the CPU 501 and other fixed data. The RAM 503 temporarily stores image data and other data.

The controller 500 has a host interface (I/F) 506 to transmit and receive data to and from a host (information processing device) 600, such as a personal computer (PC), an image output control unit 511 to control driving of the recording heads 4, and an encoder analyzer 512. The encoder analyzer 512 receives and analyzes detection signals from the main-scanning encoder sensor 24 and the sub-scanning encoder sensor 26.

The controller 500 includes a main-scanning motor driver 513 to drive the main scan motor 5, a sub scanning motor driver 514 to drive the sub-scanning motor 16, and an input/output (I/O) unit 516 between various sensors and actuators 517.

The controller 500 also includes an ejection detector 531 to measure (detect) electric changes caused when liquid droplets land on an electrode board 101 of the ejection detection unit 100 to determine ejection or non-ejection. The controller 500 further includes a wiper driver 532 to drive a wiper driving mechanism 201. The wiper driving mechanism 201 is configured to move a wiping member (wiper member) 202 to wipe the electrode board 101 of the ejection detection unit 100.

The image output control unit 511 includes a data generator to generate print data, a driving waveform generator to generate driving waveforms to control driving of the recording heads 4, and a data transmitter to transmit print data and head control signals for selecting desired driving signals from the driving waveforms. The image output control unit 511 outputs the driving waveforms, the head control signals, print data and so on to a head driver 51, which is a head driving circuit for driving the recording heads 4 mounted on the carriage 3, to eject liquid droplets from nozzles of the recording heads 4 in accordance with print data.

The encoder analyzer 512 includes a direction detector 520 to detect a movement direction of the carriage 3 from detection signals and a counter 521 to detect a movement amount of the carriage 3.

Based on analysis results transmitted from the encoder analyzer 512, the controller 500 controls driving of the main scan motor 5 via a the main scanning motor driver 513 to control movement of the carriage 3. The controller 500 also controls driving of the sub-scanning motor 16 via a sub scanning motor driver 514 to control feeding of the sheet 10.

In detection of ejection of droplets from the recording heads 4, the main control unit 500A of the controller 500 controls the recording heads 4 to move and eject droplets from desired nozzles of the recording heads 4, and determines droplet ejection states based on detection signals from the ejection detector 531.

Next, an outline of the ejection detector 531 according to some exemplary embodiments of this disclosure is described with reference to FIG. 28.

The electrode board 101 onto which liquid droplets for ejection detection are ejected from the recording heads 4 is connected to the ejection detector 531. The ejection detector 531 has a high-voltage power source 701 to supply a high voltage VE (e.g., 750V) to the electrode board 101. The main control unit 500A control on and off states of the high-voltage power source 701.

The ejection detector 531 also has a band pass filter (BPF) 702 to input signals involving electric changes when liquid droplets land on the electrode board 101, an amplification (AMP) circuit 703 to amplify the signals, and an analog-digital converter (ADC) 704 to convert the amplified signals from analog format to digital format. Resultant converted signals of the ADC 704 are input to the main control unit 500A.

When ejection detection is performed, the nozzle face 41 of one of the recording heads 4 is placed to oppose the electrode board 101. A high voltage VE is supplied to the electrode board 101 to generate a potential difference between the nozzle face 41 and the electrode board 101. At this time, the nozzle face 41 of the recording head 4 is negatively charged while the electrode board 101 are positively charged.

In such a state, a liquid droplet(s) for ejection detection is (are) ejected from each nozzle of the recording heads 4.

At this time, since liquid droplets are ejected from the nozzle face 41 negatively charged, the liquid droplets are also negatively charged. When the liquid droplets negatively charged land on the electrode board 101, the voltage of the high voltage VE supplied to the electrode board 101 slightly changes.

The band-pass filter 702 extracts the voltage change (alternative current (AC) component) and the amplification circuit 703 amplifies the AC component. The ADC 704 converts the amplified component from analog format to digital format and inputs the converted data as a measurement result (detection result) to the main control unit 500A.

The main control unit 500A determines whether the measurement result (voltage change) is greater than a preset threshold value, and if the measurement result is greater than the threshold value, the main control unit 500A determines that a detected nozzle of the recording heads 4 has ejected a liquid droplet(s). By contrast, if the measurement result is not greater than the threshold value, the main control unit 500A determines that a detected nozzle of the recording heads 4 has not ejected a liquid droplet(s).

Figure 28:
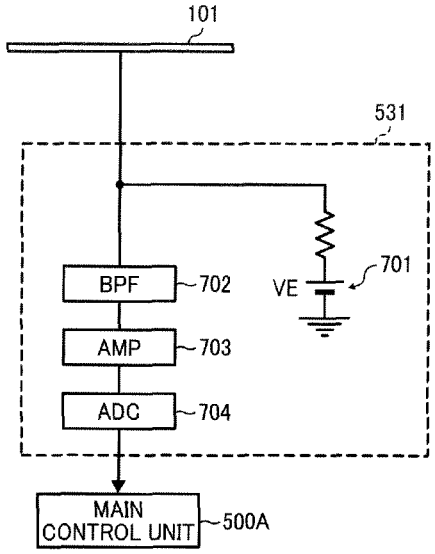
FIG. 28 is a block diagram of an ejection detector of the controller according to some exemplary embodiments of this disclosure.

In the configuration illustrated in FIG. 28, since a liquid droplet(s) is (are) ejected from each nozzle of the recording heads 4 to land on the electrode board 101, it takes approximately 0.5 to 10 msec to determine ejection or non-ejection of a single nozzle. After ejection or non-ejection of all nozzles is determined, the high voltage VE supplied to the electrode board 101 is turned into off state.

Next, an ejection detection unit according to some exemplary embodiments of this disclosure is described with reference to FIGS. 29 to 32.

Figure 29:
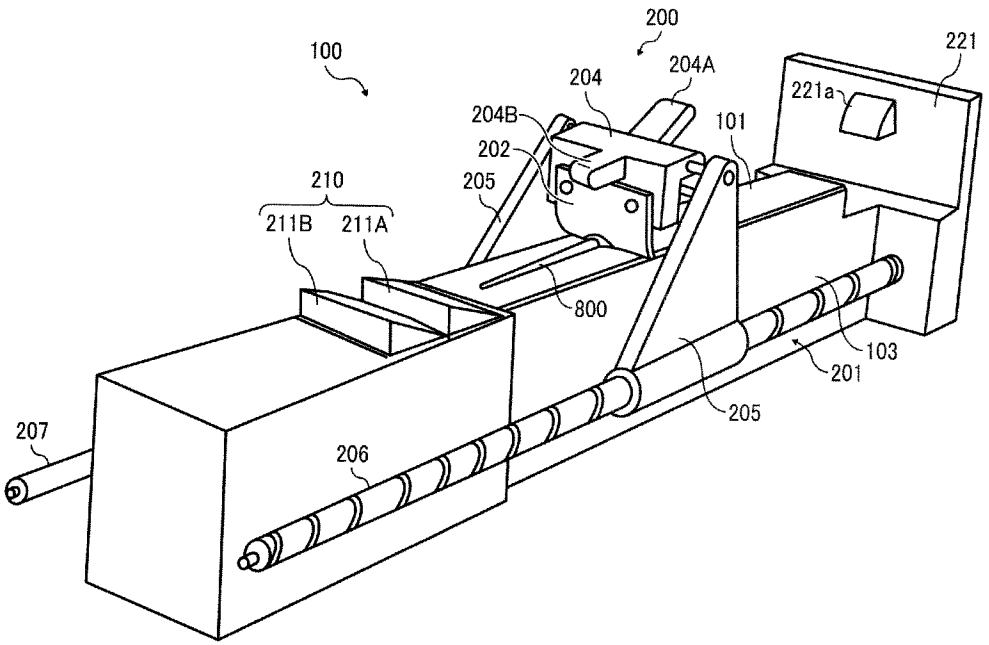
FIG. 29 is a perspective view of an ejection detection unit according to some exemplary embodiments of this disclosure in a state in which an electrode board is wiped with a wiping member.
Figure 30:
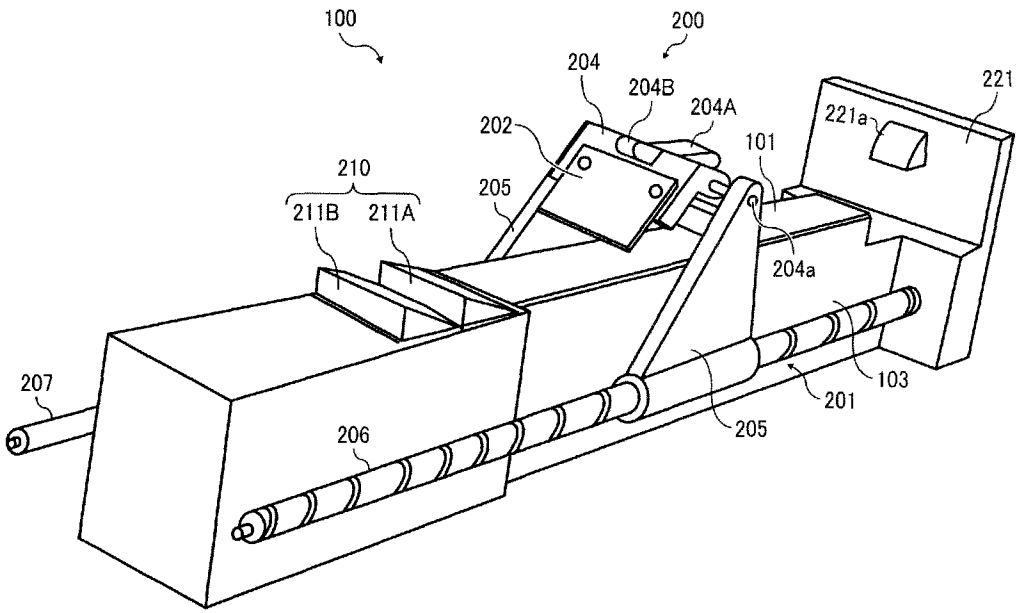
FIG. 30 is a perspective view of the ejection detection unit of FIG. 29 in a state in which the wiping member is on the way to return to a wiping start position.
Figure 31:
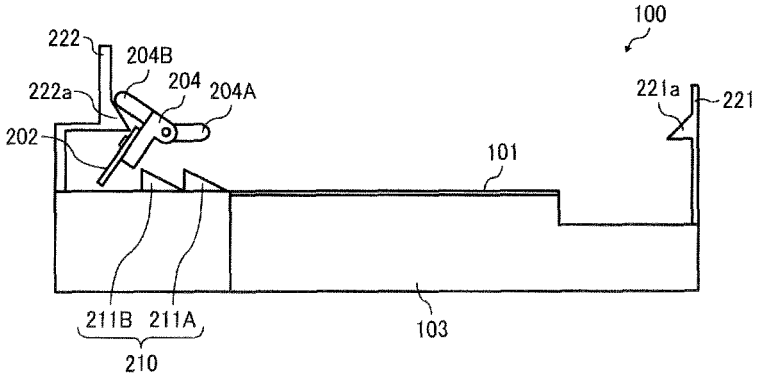
FIG. 31 is a side view of the ejection detection unit of FIG. 29 in a state in which the wiping member is placed at a home position (wiping end position)
Figure 32:
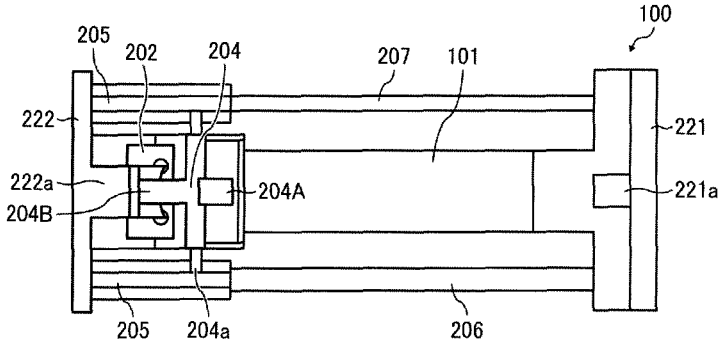
FIG. 32 is a plan view of the ejection detection unit of FIG. 29 in a state in which the wiping member is placed at the home position.

FIG. 29 is a perspective view of the ejection detection unit in a state in which an electrode board is wiped by a wiping member. FIG. 30 is a perspective view of the ejection detection unit in a state in which the wiping member is on the way to return to a wiping start position. FIG. 31 is a side view of the ejection detection unit in a state in which the wiping member is placed at a home position (wiping end position). FIG. 32 is a plan view of the ejection detection unit in the state in which the wiping member is placed at the home position (wiping end position).

The ejection detection unit 100 includes an electrode board 101 serving as an electrode member disposed on an upper face of the holder member 103 to oppose a nozzle face 41 of a recording head 4.

The holder member 103 is made of an insulation material, such as plastic.

The electrode board 101 is preferably, for example, a conductive metal plate made of a material which is rustproof and resistant to ink. The electrode board 101 may be, for example, stainless steel (SUS) 304 or copper alloy plated with nickel (Ni) or palladium (Pd). A surface of the electrode board 101 on which liquid droplets land is preferably finished to be water repellent.

The ejection detection unit 100 includes a cleaning unit 200 serving as a cleaner including the wiping member 202 to wipe liquid droplets (waste liquid) adhering to the surface of the electrode board 101.

The cleaning unit 200 includes a holding member 204 to hold the wiping member 202. The holding member 204 has opposed-end shaft portions 204*a* rotatably held by slider members 205, and has a protrusion 204A at one end and a protrusion 204B at the other end in a nozzle array direction (sub-scanning direction).

One of the slider members 205 engages a lead screw 206 disposed along a longitudinal direction of the electrode board 101 (nozzle array direction), and the other of the slider members 205 is movably held by a guide shaft 207.

When the lead screw 206 is rotated by the driving motor 203, the slider members 205 reciprocally move in the longitudinal direction of the electrode board 101.

A wall 221 serving as a first contact member is disposed upright at one end of the holder member 103 (on a wiping start side). The wall 221 has a contact portion 221*a* which the protrusion 204A of the holding member 204 contacts.

When the protrusion 204A of the holding member 204 contacts the contact portion 221 a to move the protrusion 204A upward, the holding member 204 moves to a first position (state) at which the wiping member 202 can wipe the electrode board 101.

As illustrated in FIGS. 31 and 32, a wall 222 serving as a second contact member is disposed upright at the other end of the holder member 103 (wiping end side). The wall 222 has a contact portion 222*a* which the protrusion 204B of the holding member 204 contacts.

When the protrusion 204B of the holding member 204 contacts the contact portion 222*a* and is moved upward by the contact portion 222*a*, the holding member 204 moves to a second position (state) at which the wiping member 202 is detached from (is not in contact with) the electrode board 101.

A wiper cleaner 210 serving as a cleaning member is provided to remove waste liquid adhering to the wiping member 202 to clean the wiping member 202.

The wiper cleaner 210 includes absorbers 211A and 211B disposed in turn along the nozzle array direction at a wiping end side thereof.

Here, a relation between the lengths (widths) of respective members is described below.

A relation of D<L1<L2<L3 is satisfied, where D represents a diameter of a liquid droplet that is ejected from a recording head 4 and lands on the electrode board 101, L1 represents a width of the electrode board 101 in a direction perpendicular to the nozzle array direction, L2 represents a width of the wiping member 202 in the direction perpendicular to the nozzle array direction, and L3 represents a width of an absorber 211 in the direction perpendicular to the nozzle array direction.

As a result, the electrode board 101 can be reliably wiped with the wiping member 202, and waste liquid adhering to the wiping member 202 can be reliably sucked and removed for cleaning.

The surface of the electrode board 101 has a water repellency higher than a surface of the wiping member 202. In other words, a retraction contact angle of the surface of the electrode board 101 is set to be greater than a retraction contact angle of the surface of the wiping member 202.

Such a configuration can reduce residue droplets of the electrode board 101 not wiped by the wiping member 202.

Next, operation of the ejection detection unit 100 thus configured according to some exemplary embodiments of this disclosure is described with reference to FIGS. 33A to 38C.

FIGS. 33A, 33B, 34A, and 34B are plan views of the ejection detection unit 100 in operation. FIGS. 35, 36A to 36C, 37A and 37B, and 38A to 38C are side views of the ejection detection unit 100 in operation.

Figure 33A:
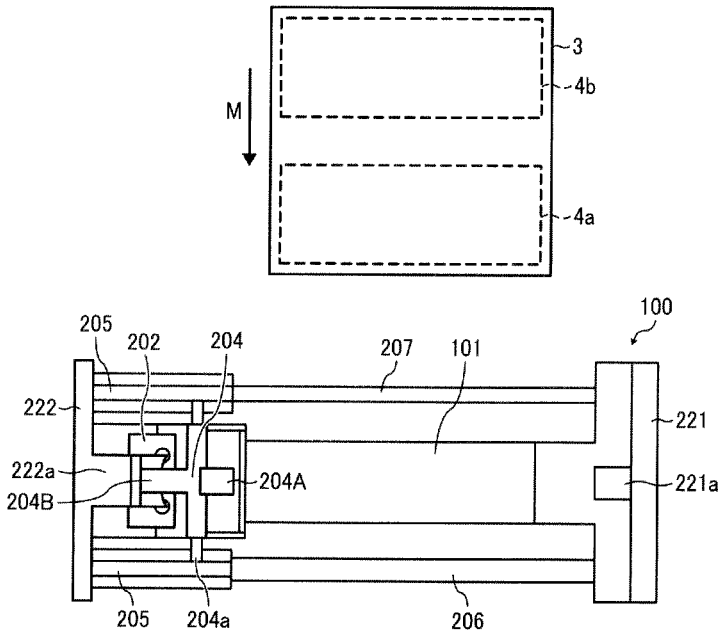
FIGS. 33A and 33B are plan views of the ejection detection unit of FIG. 29 in operation.
Figure 33B:
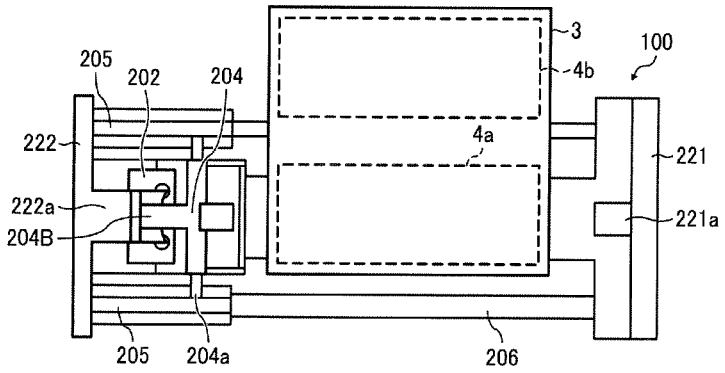

As illustrated in FIG. 33A, the carriage 3 is moved in a direction indicated by an arrow M to oppose the recording head 4*a* to the electrode board 101 of the ejection detection unit 100 as illustrated in FIG. 9B. With the recording head 4*a* opposed to the electrode board 101, ejection detection is performed on each of the nozzles of the recording head 4*a*.

Figure 34A:
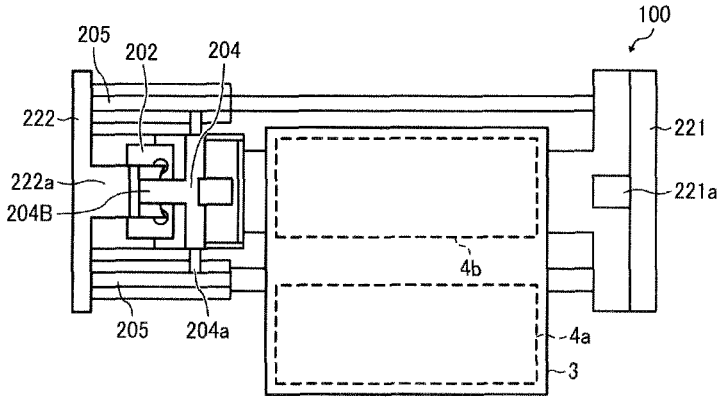
FIGS. 34A and 34B are plan views of the ejection detection unit of FIG. 29 in operation.
Figure 34B:
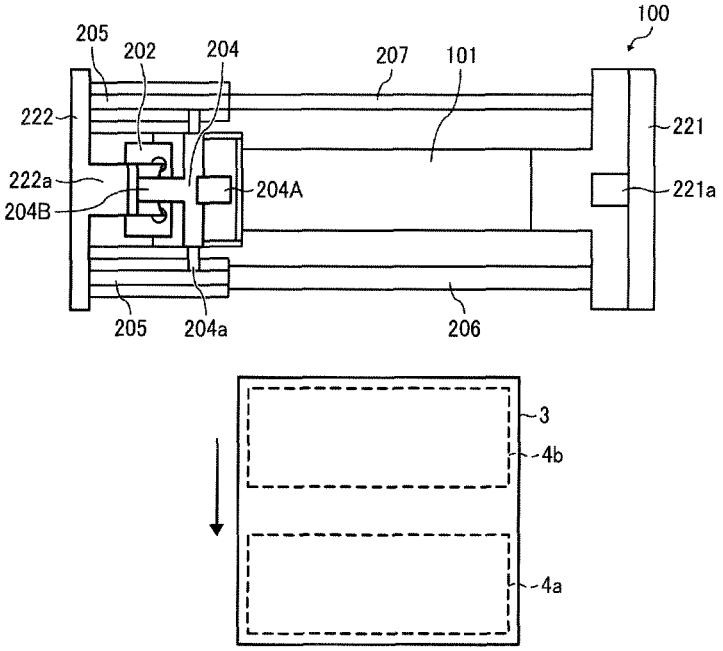

Then, as illustrated in FIG. 34A, the carriage 3 is moved to oppose the recording head 4*b* to the electrode board 101 of the ejection detection unit 100. With the recording head 4*b* opposed to the electrode board 101, ejection detection is performed on each of the nozzles of the recording head 4*b*.

By performing ejection detection as described above, as illustrated in FIG. 35, liquid droplets 800 for ejection detection are ejected on the electrode board 101.

Figure 35:
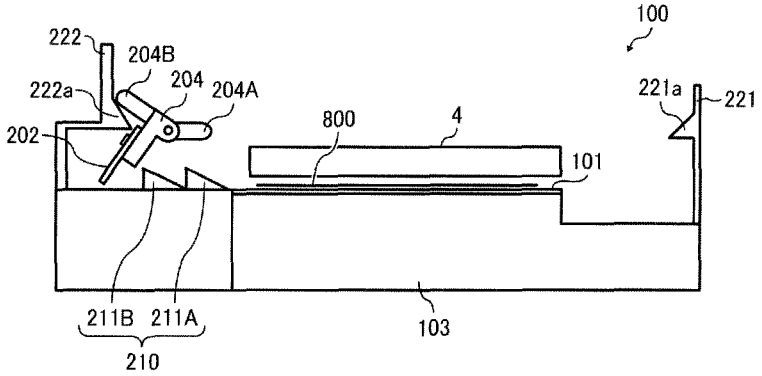
FIG. 35 is a side view of the ejection detection unit of FIG. 29.

At this time, the wiping member 202 is placed at a wiping end position (home position) illustrated in FIG. 35. When the protrusion 204B of the holding member 204 contacts the contact portion 222*a* and is moved upward by the contact portion 222*a*, the wiping member 202 is maintained in a posture at which the wiping member 202 does not contact the electrode board 101.

Figure 36A:
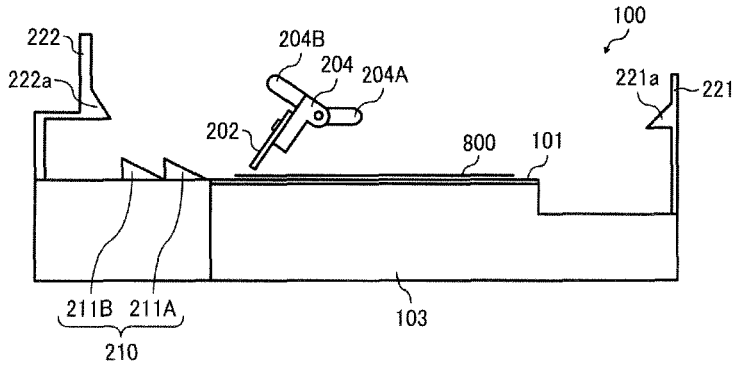
FIGS. 36A to 36C are side views of the ejection detection unit of FIG. 29 in operation.
Figure 36B:
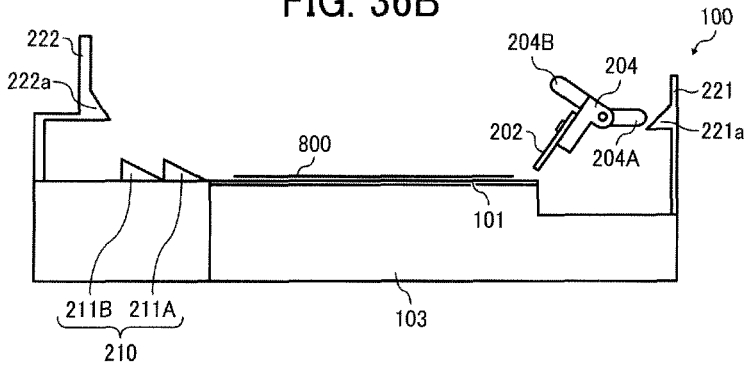
Figure 36C:
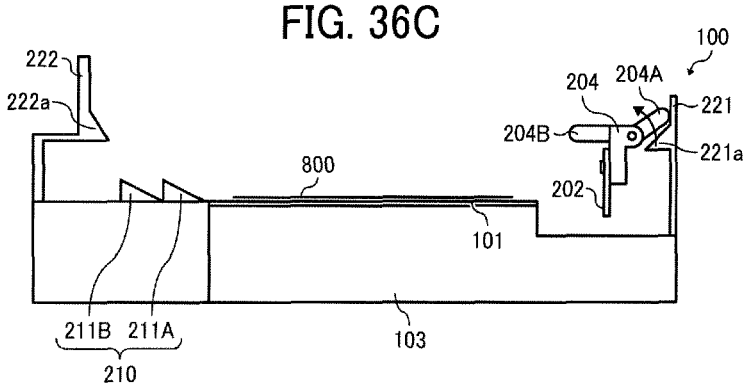

After ejection detection is finished, the lead screw 206 is rotated, and as illustrated in FIGS. 36A and 36B, the wiping member 202 is moved to the wiping start side while keeping the posture in which the wiping member 202 does not contact the electrode board 101. When the wiping member 202 arrives at the wiping start side, as illustrated in FIG. 36C, the protrusion 204A of the holding member 204 contacts the contact portion 221*a* to move the protrusion 204A upward, the holding member 204 moves to a first position (state) at which the wiping member 202 contacts (takes a wipable position relative to) the electrode board 101.

Figure 37A:
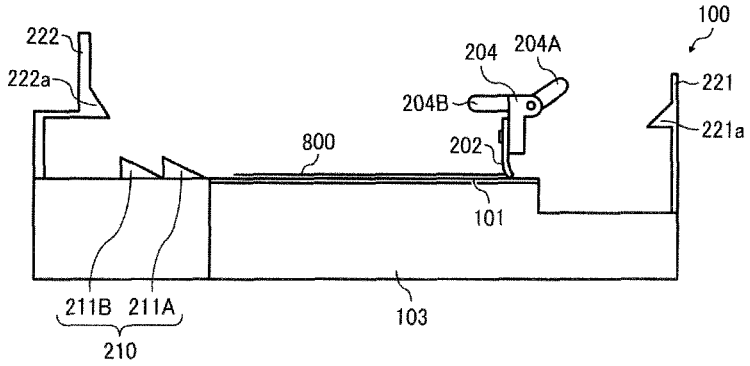
FIGS. 37A and 37B are side views of the ejection detection unit of FIG. 29 in operation.
Figure 37B:
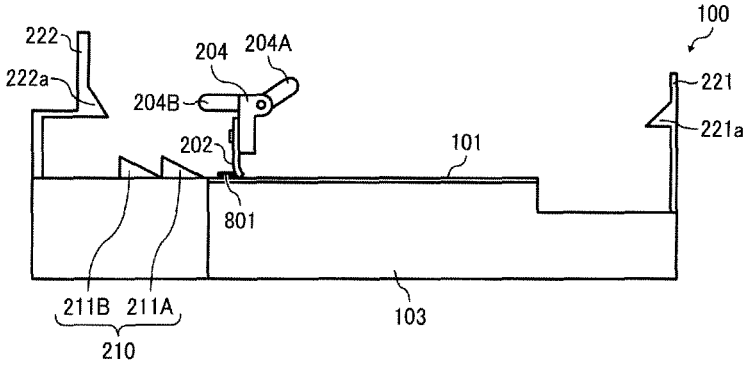

Then, by rotating the lead screw 206, the wiping member 202 is moved toward the wiping end side as illustrated in FIGS. 37A and 37B. Thus, the liquid droplets 800 on the electrode board 101 are wiped by the wiping member 202 and collected as waste liquid 801. At this time, the wiping speed is reduced at the wiping end side, thus preventing scattering of waste liquid adhering to the wiping member 202.

Figure 38A:
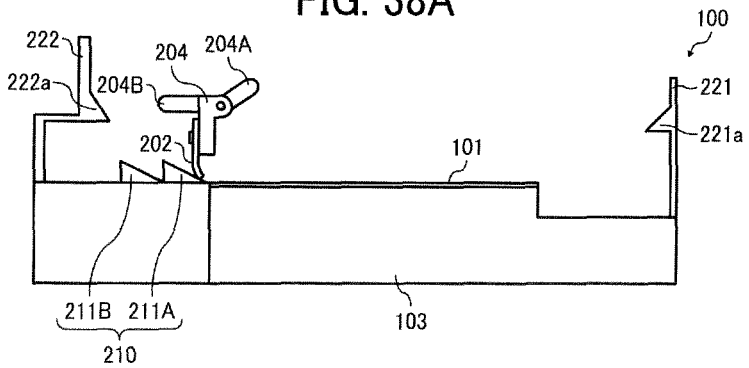
FIGS. 38A to 38C are side views of the ejection detection unit of FIG. 29 in operation.

Furthermore, by moving the wiping member 202 to the wiping end side, as illustrated in FIG. 38A, the waste liquid adhering to the wiping member 202 is absorbed and removed by the absorbers 211A and 211B in turn. Thus, the wiping member 202 is cleaned. At this time, the wiping speed is reduced at the wiping end side, thus preventing scattering of waste liquid adhering to the wiping member 202.

Figure 38B:
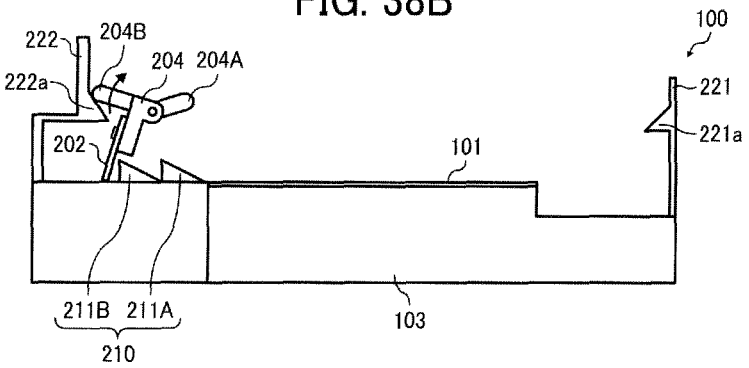
Figure 38C:
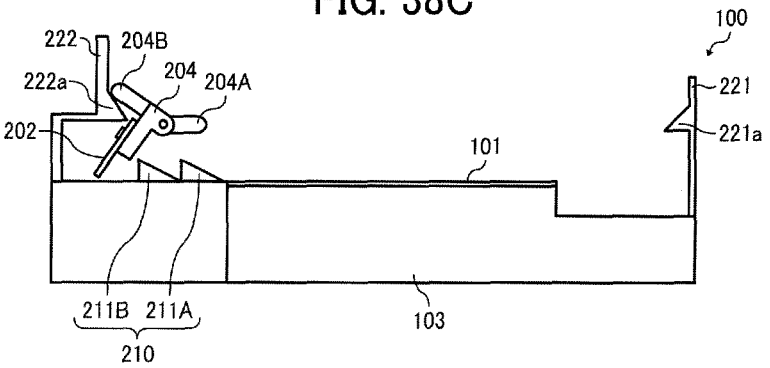

When the wiping member 202 arrives at the wiping end side, as illustrated in FIG. 38B, the protrusion 204B of the holding member 204 contacts the contact portion 221*a* and is moved upward by the contact portion 221*a*. As a result, as illustrated in FIG. 38C, the holding member 204 is rotated to take a posture in which the wiping member 202 does not contact the electrode board 101.

In this exemplary embodiment, after ejection detection is performed all of the nozzles of the nozzle rows Na and Nb of each of the recording heads 4*a* and 4*b*, wiping is performed on the electrode board 101. In some embodiments, ejection detection and wiping are performed on each recording head 4.

However, typically, since the amount of ink adhering to the electrode board by ejection detection on a single recording head is small and a large amount of ink is unlikely to be collected into the waste liquid tank by cleaning, waste liquid can be more effectively collected by cleaning the electrode board after ejection detection is performed on the nozzles of all colors once or multiple times.

Figure 39:
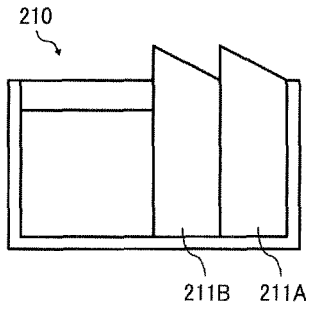
FIG. 39 is a schematic view of a wiper cleaner according to some exemplary embodiments of this disclosure.
Figure 40:
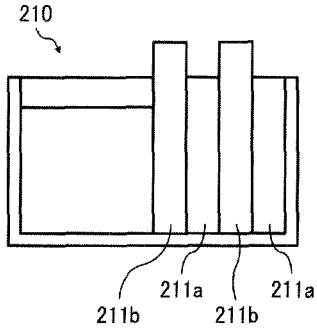
FIG. 40 is a schematic view of a wiper cleaner according to some exemplary embodiments of this disclosure.

Here, different configurations of a wiper cleaner according to some exemplary embodiment is described with reference to FIGS. 39 and 40. FIGS. 39 and 40 are side views of absorbers.

A first example of the wiper cleaner 210 illustrated in FIG. 39 has the same configuration as the above-described exemplary embodiments in which absorbers 211A and 211E are sequentially arranged and have contact portions formed as inclined surfaces to contact the wiping member 202. Thus, the absorbers 211A and 211B form an irregular surface to contact the wiping member 202.

In the first example of FIG. 39, when the wiping member 202 contacts the absorber 211A, the absorber 211A absorbs waste liquid adhering to the wiping member 202. However, such cleaning operation is repeated many times, the absorber 211A turns into a state in which the absorber 211A cannot the waste liquid. In the first example, the absorber 211B absorbs such waste liquid that cannot be absorbed by the absorber 211A.

Such a configuration allows cleaning of the wiping member to be performed over a relatively long period of time.

In the first example, the absorbers 211A and 211B form two mountainous portions. In some embodiments, a three or more mountainous portions are formed by absorbers in accordance with an amount of waste liquid to be absorbed, depending on the amount of ink ejected for ejection detection, frequency of activation, product life of the apparatus (or module), and assumed environment.

Next, in the second example illustrated in FIG. 40, lower absorbers 211*a* and higher absorbers 211*b* are alternately arranged in a wiping direction. Like the first example, the absorbers 211*a* and 211*b* of the second example form an irregular surface to contact the wiping member 202.

In some embodiments, five or more mountainous portions are formed by absorbers in accordance with an amount of waste liquid to be absorbed.

Next, an ejection detection unit according to some exemplary embodiments of this disclosure is described with reference to FIGS. 41 to 42.

Figure 41:
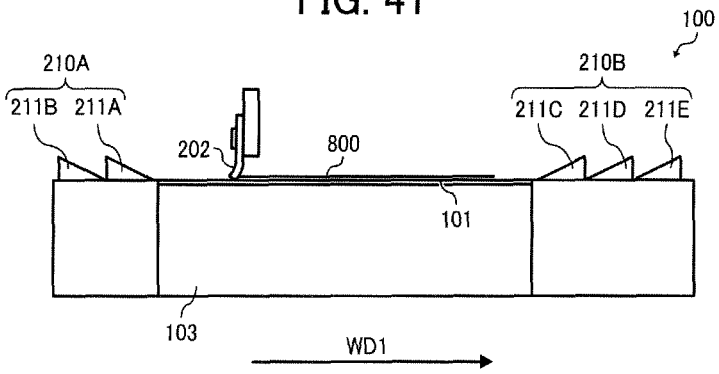
FIG. 41 is a side view of an ejection detection unit according to some exemplary embodiments of this disclosure in a state in which an electrode board is wiped with a wiping member.
Figure 42:
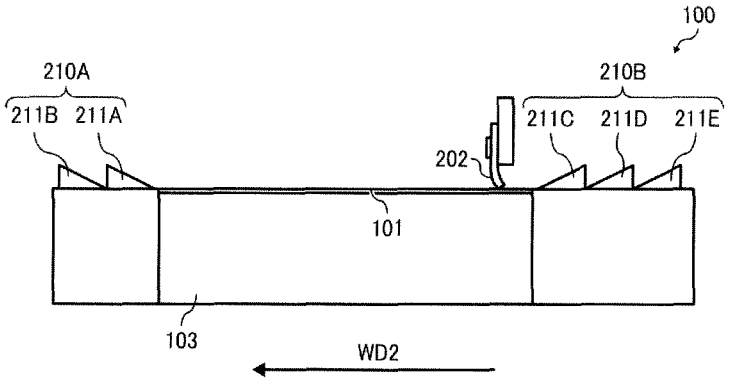
FIG. 42 is a side view of the ejection detection unit of FIG. 41 in a state in which the electrode board is wiped with the wiping member in a wiping direction opposite a wiping direction of FIG. 41.

FIGS. 41 and 42 are side views of an ejection detection unit 100 according to some exemplary embodiments.

In FIGS. 41 and 42, the ejection detection unit 100 has a wiper cleaner 210B forming part of a cleaner at one end and a wiper cleaner 201A at the opposed end in a nozzle array direction. The wiper cleaner 210B includes absorbers 211C, 211D, and 211E, and the wiper cleaner 210 includes absorbers 211A and 211B.

As illustrated in FIG. 41, when the wiping member 202 is moved in a wiping direction indicated by an arrow WD1 to wipe the electrode board 101, the absorbers 211C, 211D, and 211E contact, absorb, and remove waste liquid adhering to the wiping member 202 to clean the wiping member 202.

As illustrated in FIG. 42, when the wiping member 202 is moved in a wiping direction indicated by an arrow WD2, which is opposite to the wiping direction WD1, to wipe the electrode board 101, the absorbers 211A and 211B contact, absorb, and remove waste liquid adhering to the wiping member 202 to clean the wiping member 202.

In other words, in the above-described configuration illustrated in FIGS. 41 and 42, like the configuration of FIGS. 29 to 32, the wiping member 202 and the holding member 204 do not rotate and are reciprocally moved in a sub-scanning direction.

As described above, the wiping member and the electrode member are relatively moved in the direction parallel to the nozzle array direction to clean the electrode member. Such a configuration reduce fixedly adherence and accumulation of waste liquid in the cleaning member for cleaning the wiping member and the wiping member, thus suppressing deterioration of the wiping performance of the wiping member over time. As a result, droplet ejection detection can be performed at high accuracy.

The cleaning member is also provided to remove waste liquid adhering to the wiping member to clean the wiping member, thus allowing maintaining of wiping performance over a long period of time.

It is to be noted that the above-described control of droplet ejection detection operation can be performed by a computer according to a program stored in, e.g., the ROM of the controller. The program may be provided as a recording medium storing the program therein or may be provided so as to be downloaded through a network, e.g., the Internet.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a recording head having a plurality of nozzles to eject droplets and a nozzle face in which the plurality of nozzles is formed;

an ejection detector to detect ejection or non-ejection of the droplets from the recording head, the ejection detector having an electrode member disposed in an area in which the electrode member is opposable to the recording head, the electrode member on which the droplets ejected from the plurality of nozzles of the recording head land; and a cleaner to clean the electrode member after ejection or non-ejection of the droplets from the plurality of nozzles is detected by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member, the cleaner including a wiping member to wipe the droplets adhering to the electrode member, the wiping member and the electrode member configured to be relatively moved in parallel to a nozzle array direction in which the plurality of nozzles is arrayed, to clean the electrode member.

2. The image forming apparatus of claim 1, further comprising:

a member having an opening at a terminal end in a wiping direction in which the wiping member wipes the electrode member, and a cleaning member disposed in the opening to remove waste liquid adhering to the wiping member.

3. The image forming apparatus of claim 2, wherein a relation of $D<L1<L2<L4$ is satisfied, where D represents a diameter of the droplets ejected from the recording head and landing on the electrode member, L1 represents a width of the electrode member in a direction perpendicular to the nozzle array direction, L2 represents a width of the wiping member in the direction perpendicular to the nozzle array direction, and L4 represents a width of the opening in the direction perpendicular to the nozzle array direction.

4. The image forming apparatus of claim 1, wherein a relation of $D<L1<L2<L3$ is satisfied, where D represents a diameter of the droplets ejected from the recording head and landing on the electrode member, L1 represents a width of the electrode member in a direction perpendicular to the nozzle array direction, L2 represents a width of the wiping member in the direction perpendicular to the nozzle array direction, and L3 represents a width of the cleaning member in the direction perpendicular to the nozzle array direction.

5. The image forming apparatus of claim 1, wherein the cleaner includes a waste liquid receiver to receive waste liquid dropping from the wiping member when the wiping member is placed at a retracted position at which the wiping member is retracted from the electrode member.

6. The image forming apparatus of claim 1, further comprising a carriage mounting the recording head and reciprocally movable, wherein the cleaner is mounted on the carriage.

7. The image forming apparatus of claim 1, further comprising a driving source disposed at an apparatus body side to move the wiping member.

8. The image forming apparatus of claim 1, further comprising a moving unit to move the electrode member relative to the wiping member of the cleaner.

9. The image forming apparatus of claim 1, wherein the wiping member has a higher water repellency than the electrode member.

10. An image forming apparatus, comprising:

a recording head having a plurality of nozzles to eject droplets and a nozzle face in which the plurality of nozzles is formed; and a cleaner to clean a electrode member after the droplets ejected from the plurality of nozzles of the recording head land on the electrode member in a state in which a potential difference is created between the nozzle face of the recording head and the electrode member and the nozzle face of the recording head is opposed to the electrode member, the cleaner including a wiping member to wipe the droplets adhering to the electrode member.

the wiping member and the electrode member configured to be relatively moved in parallel to a nozzle array direction in which the plurality of nozzles is arrayed, to clean the electrode member.

11. An image forming apparatus, comprising:

a recording head having a plurality of nozzles to eject droplets and a nozzle face in which the plurality of nozzles is formed;

an ejection detector to detect ejection or non-ejection of the droplets from the recording head, the ejection detector having an electrode member disposed in an area in which the electrode member is opposable to the recording head, the electrode member on which the droplets ejected from the plurality of nozzles of the recording head land; and a cleaner to clean the electrode member after ejection or non-ejection of the droplets from the plurality of nozzles is detected by detection of electric changes of the electrode member generated when the droplets ejected from the plurality of nozzles of the recording head land on the electrode member in a state in which a potential difference is created between the nozzle face of the recording head and the electrode member and the nozzle face of the recording head is opposed to the electrode member, the cleaner including a wiping member to wipe the droplets adhering to the electrode member, the wiping member and the electrode member configured to be relatively moved in parallel to a nozzle array direction in which the plurality of nozzles is arrayed, to clean the electrode member, and a cleaning member to remove waste liquid adhering to the wiping member to clean the wiping member.

12. The image forming apparatus of claim 11, wherein the cleaning member includes an absorber to absorb the waste liquid adhering to the wiping member and is configured to relatively move the absorber relative to the wiping member to absorb and remove the waste liquid.

13. The image forming apparatus of claim 12, wherein a relation of $D<L1<L2<L3$ is satisfied, where D represents a diameter of the droplets ejected from the recording head and landing on the electrode member, L1 represents a width of the electrode member in a direction perpendicular to the nozzle array direction, L2 represents a width of the wiping member in the direction perpendicular to the nozzle array direction, and L3 represents a width of the absorber in the direction perpendicular to the nozzle array direction.

14. The image forming apparatus of claim 12, wherein the absorber has an irregular surface to contact the wiping member.

15. The image forming apparatus of claim 12, wherein the absorber has an inclined surface to contact the wiping member.

16. The image forming apparatus of claim 11, further comprising a holding member to hold the wiping member, wherein the holding member is movable at least between a first state in which the wiping member takes a wipable position relative to the electrode member and a second state in which the wiping member does not contact the electrode member, the ejection detector includes a first contact member at a wiping start side at which the wiping member starts wiping the electrode member and a second contact member at a wiping end side at which the wiping member finishes wiping the electrode member, and the holding member is configured to take the first position by contacting the first contact member and take the second position by contacting the second contact member.

17. The image forming apparatus of claim 11, wherein the electrode member has a higher water repellency than the wiping member.

18. The image forming apparatus of claim 11, wherein the recording head has multiple nozzle rows of the plurality of nozzles, and the wiping member is configured to wipe the electrode member after detection of ejection or non-ejection of the droplets from the plurality of nozzles is finished on all of the plurality of nozzles of the multiple nozzle rows.

19. The image forming apparatus of claim 11, wherein the wiping member is configured to decelerate when the wiping member finished wiping the electrode member.

* * * * *